US012571275B2

(12) United States Patent
Emmett et al.

(10) Patent No.: US 12,571,275 B2
(45) Date of Patent: Mar. 10, 2026

(54) WELLHEAD SYSTEMS AND METHODS

(71) Applicant: Cactus Wellhead, LLC, Houston, TX (US)

(72) Inventors: Jacob Charles Emmett, Houston, TX (US); Bradley Wilson Jones, Pearland, TX (US); James Dean Smith, New Waverly, TX (US); Martin Anthony Trumbull, Hockley, TX (US)

(73) Assignee: Cactus Wellhead, LLC, Houston, TX (US)

( * ) Notice: Subject to any disclaimer, the term of this patent is extended or adjusted under 35 U.S.C. 154(b) by 0 days.

(21) Appl. No.: 19/088,601

(22) Filed: Mar. 24, 2025

(65) Prior Publication Data

US 2025/0305380 A1 Oct. 2, 2025

Related U.S. Application Data

(60) Provisional application No. 63/573,870, filed on Apr. 3, 2024, provisional application No. 63/569,861, filed on Mar. 26, 2024.

(51) Int. Cl.

| | |
|---|---|
| ***E21B 3/04*** | (2006.01) |
| ***E21B 17/08*** | (2006.01) |
| ***E21B 23/00*** | (2006.01) |
| ***E21B 33/04*** | (2006.01) |

(52) U.S. Cl.

CPC ..... *E21B 33/04* (2013.01); *E21B 23/00* (2013.01); *E21B 17/08* (2013.01)

(58) Field of Classification Search

CPC ..... E21B 33/03; E21B 33/04; E21B 33/0415; E21B 23/00; E21B 23/01

See application file for complete search history.

(56) References Cited

U.S. PATENT DOCUMENTS 2,003,446 A * 6/1935 Imler ..... E21B 33/04 166/88.1
4,384,726 A * 5/1983 Meyer ..... F16J 15/20 277/516

(Continued)

OTHER PUBLICATIONS

Vault Pressure Control, RSH-SCH Wellhead System, https://www.vaultpc.com/rsh-wellhead.

*Primary Examiner* — George S Gray
(74) *Attorney, Agent, or Firm* — Conrad J. Hsu

(57) ABSTRACT

Techniques for an improved wellhead. The wellhead includes a casing hanger that suspends a casing string within a wellbore, a casing head, a retainer ring assembly, and a radial retainer fastener. The casing hanger includes external hanger threading that interlocks with internal tool threading in a casing running tool to facilitate manipulating the casing hanger via the casing running tool. The retainer ring assembly includes an external retainer groove and internal ring threading that interlocks with the external hanger threading on the casing hanger after the casing running tool is disconnected from the casing hanger to facilitate securing the retainer ring assembly to the casing hanger. The radial retainer fastener is secured through a radial fastener opening in the casing head into the external retainer groove on the retainer ring assembly to facilitate securing the casing head to the retainer ring assembly and, thus, the casing hanger.

19 Claims, 14 Drawing Sheets

(56) References Cited

U.S. PATENT DOCUMENTS

| | | | | |
|---|---|---|---|---|
| 5,611,398 | A * | 3/1997 | Duhn | E21B 33/04 166/85.3 |
| 9,534,465 | B2 | 1/2017 | Nguyen et al. | |
| 10,094,188 | B1 | 10/2018 | Smith | |
| 12,054,997 | B2 | 8/2024 | Armistead et al. | |
| 2014/0116723 | A1* | 5/2014 | Nguyen | E21B 33/03 166/377 |
| 2021/0324699 | A1 | 10/2021 | Trumbull et al. | |
| 2023/0212922 | A1* | 7/2023 | Wright | E21B 23/01 285/123.1 |
| 2023/0374881 | A1* | 11/2023 | Nguyen | E21B 33/0353 |
| 2024/0183242 | A1 | 6/2024 | Wright et al. | |

* cited by examiner

WELLHEAD SYSTEMS AND METHODS

CROSS-REFERENCE

The present disclosure claims priority to and benefit of U.S. Provisional Application No. 63/569,861, entitled "IMPROVED WELLHEAD SYSTEMS AND METHODS" and filed Mar. 26, 2024, as well as U.S. Provisional Application No. 63/573,870, entitled "WELLHEAD BI-DIRECTIONAL LOCKRING GROOVE SYSTEMS AND METHODS" and filed Apr. 3, 2024, which are each incorporated herein by reference in its entirety for all purposes.

BACKGROUND

The present disclosure generally relates to well systems and, more particularly, to a wellhead that may be deployed in a well system.

A wellhead may generally be deployed in a well system to facilitate drilling a well, such as an oil or gas well, and/or producing fluid from the well. However, at least in some instances, the design of a wellhead may inadvertently limit deployment (e.g., installation) efficiency of the wellhead, drilling efficiency of a corresponding well, and/or production efficiency of the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a well system includes a wellhead. The wellhead includes a casing hanger that suspends a casing string within a wellbore, a casing head, a retainer ring assembly, and a radial retainer fastener. The casing hanger includes external hanger threading that interlocks with internal tool threading in a casing running tool to facilitate manipulating the casing hanger via the casing running tool. The retainer ring assembly includes an external retainer groove and internal ring threading that interlock with the external hanger threading on the casing hanger after the casing running tool is disconnected from the casing hanger to facilitate securing the retainer ring assembly to the casing hanger. The radial retainer fastener is secured through a radial fastener opening in the casing head into the external retainer groove on the retainer ring assembly to facilitate securing the casing head to the retainer ring assembly and, thus, the casing hanger.

In another embodiment, a method of deploying a wellhead in a well system includes securing a casing running tool to a casing hanger at least in part by interlocking internal tool threading on the casing running tool with external hanger threading on the casing hanger; manipulating the casing hanger using the casing running tool to suspend a casing string within a wellbore; disconnecting the casing running tool from the casing hanger at least in part by disengaging the internal tool threading on the casing running tool from the external hanger threading on the casing hanger; securing a retainer ring assembly to the casing hanger at least in part by interlocking internal ring threading on the retainer ring assembly with the external hanger threading on the casing hanger; and securing a radial retainer fastener through a radial fastener opening in a casing head into an external retainer groove on the retainer ring assembly to facilitate securing the casing head to the retainer ring assembly and, thus, the casing hanger.

In a further embodiment, a well system includes a retainer ring assembly and a radial retainer fastener. The retainer ring assembly includes an external retainer groove and internal ring threading that interlocks with external hanger threading on a surface casing hanger to facilitate securing the retainer ring assembly to the surface casing hanger. The radial retainer fastener is secured through a radial fastener opening in a casing head into the external retainer groove on the retainer ring assembly to facilitate securing the casing head to the retainer ring assembly and, thus, the surface casing hanger.

DETAILED DESCRIPTION

Figure 1:
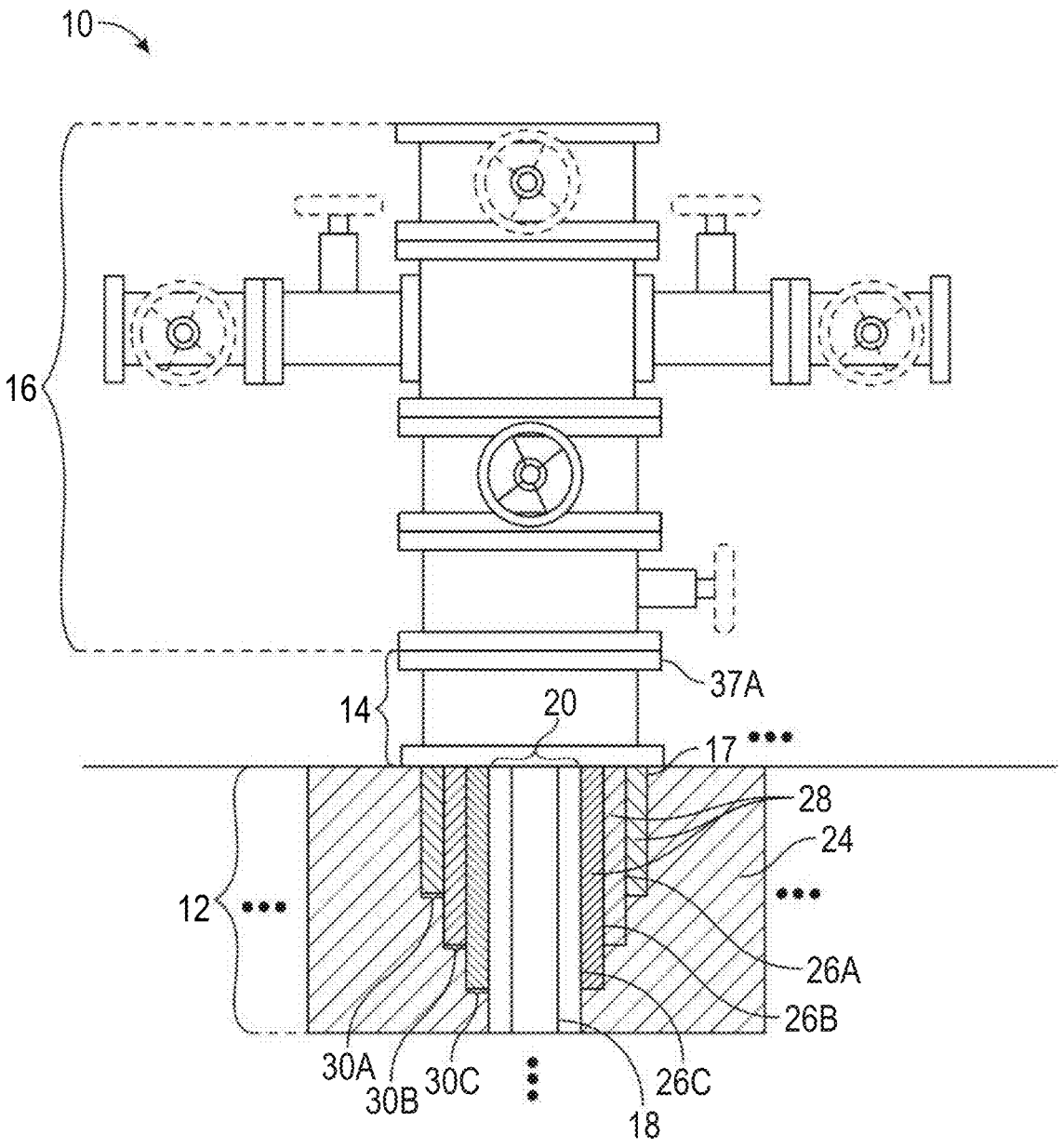
FIG. 1 is a partial side cross-sectional view of an example of a well system, in accordance with an embodiment of the present disclosure.

One or more specific embodiments of the present disclosure will be described below with reference to the figures. Wherever possible, like or identical reference numerals are used in the figures to identify common or the same features. The figures are not necessarily to scale. In particular, certain features and/or certain views of the figures may be shown exaggerated in scale for purposes of clarification. As used herein, the term "coupled" or "coupled to" may indicate establishing either a direct or indirect connection and, thus, is not limited to either unless expressly referenced as such.

The present disclosure generally relates to well systems. More specifically, the present disclosure relates to a wellhead that may be deployed in a well system to facilitate drilling a well, such as an oil or gas well, and/or producing fluid from the well.

To help illustrate, an example of a well system 10 is shown in FIG. 1. As in the depicted example, a well system 10 may generally include a wellhead 14, which is implemented to be secured on a well 12, and a valve tree (e.g., stack) 16, which is implemented to be secured on the wellhead 14. In particular, as in the depicted example, in some embodiments, a wellhead 14 may land (e.g., rest) on a conductor pipe 17, for example, which is driven into a ground formation 24 before drilling of a corresponding well 12. Additionally, as in the depicted example, to facilitate producing fluid from a well 12, a wellhead 14 generally suspends a production tubing string 18 within a wellbore 20 of the well 12.

However, it should be appreciated that the depicted example is merely intended to be illustrative and not limiting. In particular, in other embodiments, a conductor pipe 17 may not be used. Additionally, as will be described in more detail below, a wellhead 14 may also be used during drilling of a well 12 and, thus, may not suspend a production tubing string 18 at that time. Furthermore, as will be described in more detail below, in some embodiments, a valve tree 16, such as blowout preventer (BOP) stack, may be secured on a wellhead 14 using a different type of connection, for example, a threaded hub and a drilling adapter instead of a flange 37A.

In any case, as in the depicted example, to facilitate structurally supporting a wellbore 20 as well as fluidly isolating the wellbore 20 from the surrounding ground formations 24, a wellhead 14 generally suspends one or more casing strings 26 within the wellbore 20. In particular, in the depicted example, the wellhead 14 concentrically suspends a surface (e.g., outer) casing string 26A, an intermediate casing string 26B, and a production (e.g., inner) casing string 26C. To facilitate improving structural support and/or fluid isolation provided by a casing string 26, as in the depicted example, cement 28 may be disposed (e.g., filled) within an annulus 30 surrounding the casing string 26. In particular, in the depicted example, cement 28 is disposed within an outer annulus 30A surrounding the surface casing string 26A, an intermediate annulus 30B surrounding the intermediate casing string 26B, and an inner annulus 30C surrounding the production casing string 26C.

However, it should again be appreciated that the depicted example is merely intended to be illustrative and not limiting. In particular, in other embodiments, cement 28 may not be disposed within an annulus 30 surrounding a casing string 26. Additionally, in other embodiments, a wellhead 14 may concentrically suspend fewer than three (e.g., two or one) casing strings 26 or more than three (e.g., four, five, or more) casing strings 26. In any case, a wellhead 14 may generally include a casing hanger to support and suspend a casing string 26 within a wellbore 20 of a well 12.

Figure 2:
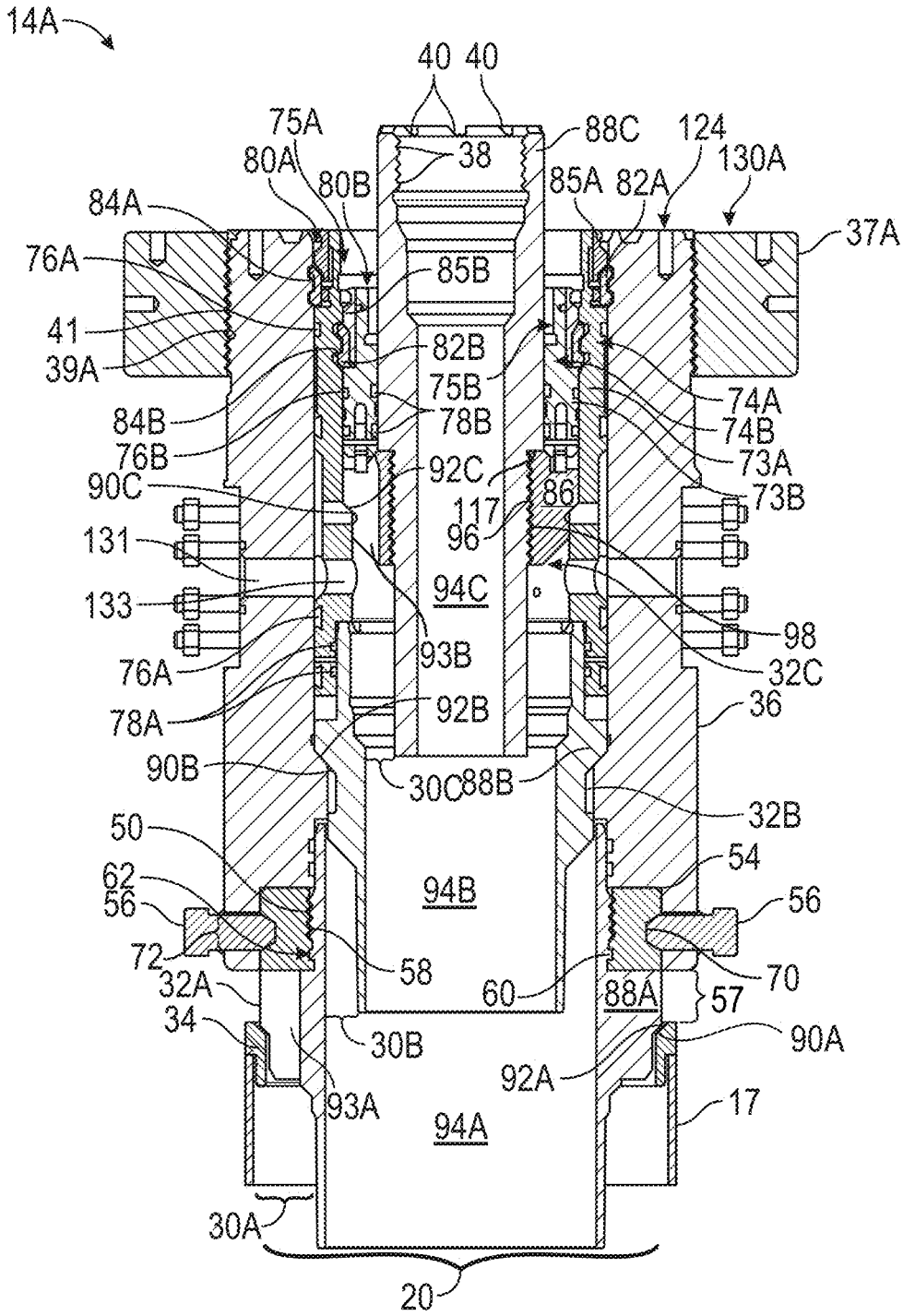
FIG. 2 is a side cross-sectional view of an example of a wellhead that may be deployed in the well system of FIG. 1, in accordance with an embodiment of the present disclosure.

To help illustrate, a more detailed example of a wellhead 14A is shown in FIG. 2. As in the depicted example, to facilitate suspending a surface casing string 26A within a corresponding wellbore 20, a wellhead 14 may include a surface (e.g., outer) casing hanger 32A, which is implemented to be secured to an upper end of the surface casing string 26A. In particular, in the depicted example, the surface casing hanger 32A generally includes a hanger body 88A that defines a hanger bore 94A, which extends therethrough, and an external landing shoulder 90A, which is implemented (e.g., positioned, sized, and/or shaped) to land (e.g., rest) on an internal landing shoulder 92A of a landing ring 34 that is secured (e.g., welded) on a conductor pipe 17. Additionally, to facilitate fluid flow into and/or out of an outer annulus 30A surrounding the surface casing string 26A, in the depicted example, the hanger body 88A defines a fluid circulation flute 93A that extends through a periphery of the surface casing hanger 32A, for example, parallel to the hanger bore 94A.

Furthermore, to facilitate suspending an intermediate casing string 26B concentrically with a surface casing string 26A, as in the depicted example, a wellhead 14 may include a casing head (e.g., spool) 36, which is implemented to be secured to a corresponding surface casing hanger 32A, and an intermediate casing hanger 32B, which is implemented to be secured to an upper end of the intermediate casing string 26B and to land within the casing head 36. Similar to the surface casing hanger 32A, the intermediate casing hanger 32B generally includes a hanger body 88B that defines a hanger bore 94B, which extends therethrough, and an external landing shoulder 90B, which is implemented (e.g., positioned, sized, and/or shaped) to land (e.g., rest) on an internal landing shoulder 92B in the casing head 36.

However, it should be appreciated that the depicted example is merely intended to be illustrative and not limiting. In particular, instead of a mandrel hanger, in other embodiments, a casing hanger 32 in a wellhead 14 may be a different type of casing hanger 32, for example, a slip (e.g., emergency) casing hanger 32. Additionally or alternatively, in other embodiments, a casing hanger 32 in a wellhead 14 may not include a fluid circulation flute 93. In any case, a wellhead component, such as a casing hanger 32, may generally be manipulated (e.g., moved, deployed, and/or removed) using a corresponding running tool.

Figure 3:
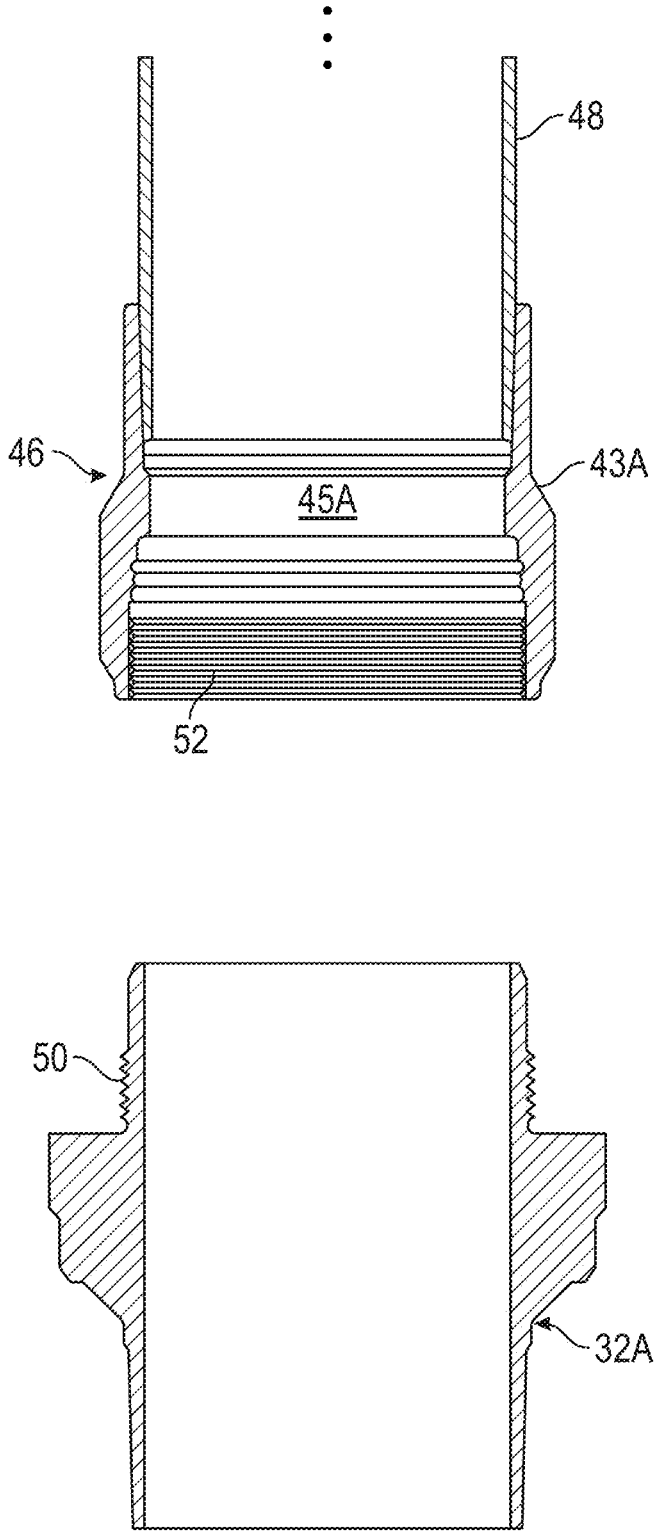
FIG. 3 is a side cross-sectional view of an example of a surface casing hanger that may be deployed in a wellhead and a corresponding casing running tool, in accordance with an embodiment of the present disclosure.

To help illustrate, an example of a surface casing hanger 32A and a corresponding running tool—namely a surface casing running tool 46—is shown in FIG. 3. As in the depicted example, a surface casing running tool 46 generally includes a tool body 43A, which defines a tool bore 45A that extends therethrough.

Additionally, as depicted, to facilitate manipulating the surface casing running tool 46, an upper end of the surface casing running tool 46 is secured to a landing joint 48, which is or is to be suspended from a derrick. Furthermore, as depicted, to facilitate selectively securing the surface casing running tool 46 to the surface casing hanger 32A, a lower end of the surface casing running tool 46 includes internal tool threading 52, which is implemented (e.g., positioned, shaped, and/or sized) to interlock with external hanger threading 50 on the surface casing hanger 32A. Accordingly, the surface casing running tool 46 may be secured to the surface casing hanger 32A at least in part by rotating the surface casing running tool 46 in a first (e.g., left and/or counter-clockwise) direction relative to the surface casing hanger 32A to interlock the internal tool threading 52 on the surface casing running tool 46 with the external hanger threading 50 on the surface casing hanger 32A. On the other hand, the surface casing running tool 46 may be disconnected (e.g., removed) from the surface casing hanger 32A at least in part by rotating the surface casing running tool 46 in a second (e.g., right, clockwise, and/or opposite) direction relative to the surface casing hanger 32A to disengage the internal tool threading 52 on the surface casing running tool 46 from the external hanger threading 50 on the surface casing hanger 32A.

Returning to FIG. 2, to facilitate securing a casing head 36 and, thus, its other components to a surface casing hanger 32A, as in the depicted example, a wellhead 14 may include a retainer ring assembly 54 as well as one or more radial retainer fasteners (e.g., screws and/or bolts) 56. In particular, as depicted, the retainer ring assembly 54 includes internal ring threading 58, which is implemented (e.g., positioned, shaped, and/or sized) to interlock with external hanger threading 50 on the surface casing hanger 32A. Accordingly, while interlocked, the internal ring threading 58 on the retainer ring assembly 54 and the external hanger threading 50 on the surface casing hanger 32A may axially secure the retainer ring assembly 54 to the surface casing hanger 32A-provided that the retainer ring assembly 54 and the surface casing hanger 32 do not rotate relative to one another.

In fact, as in the depicted example, to facilitate blocking a retainer ring assembly 54 from inadvertently rotating relative to a surface casing hanger 32A, in some embodiments, the retainer ring assembly 54 may include an internal retainer notch (e.g., groove) 62 adjacent to (e.g., above or below) its internal ring threading 58, which is implemented (e.g., positioned, sized, and/or shaped) to interlock with an external retainer protrusion 60 on the surface casing hanger 32A. Accordingly, while interlocked, the external retainer protrusion 60 on the surface casing hanger 32A and the internal retainer notch 62 on the retainer ring assembly 54 may block the retainer ring assembly 54 and the surface casing hanger 32A from moving axially relative to one another and, thus, the retainer ring assembly 54 and the surface casing hanger 32A from rotating relative to one another, thereby utilizing the internal ring threading 58 on the retainer ring assembly 54 and the external hanger threading 50 on the surface casing hanger 32A to further block the retainer ring assembly 54 and the surface casing hanger 32A from inadvertently moving axially relative to one another, for example, to better handle substantial forces (e.g., weight) that can be expected.

However, it should again be appreciated that the depicted example is merely intended to be illustrative and not limiting. In particular, in other embodiments, a retainer ring assembly 54 may not include an internal retainer notch 62, for example, instead including an internal retainer protrusion that is implemented (e.g., positioned, sized, and/or shaped) to interlock with an external retainer notch on a corresponding casing hanger 32. In any case, to facilitate interlocking internal ring threading 58 on a retainer ring assembly 54 with external hanger threading 50 on a surface casing hanger 32A while interlocking an internal retainer notch 62 on the retainer ring assembly 54 with an external retainer protrusion 60 on the surface casing hanger 32A, in some embodiments, the retainer ring assembly 54 may be implemented using multiple ring segments.

Figure 4:
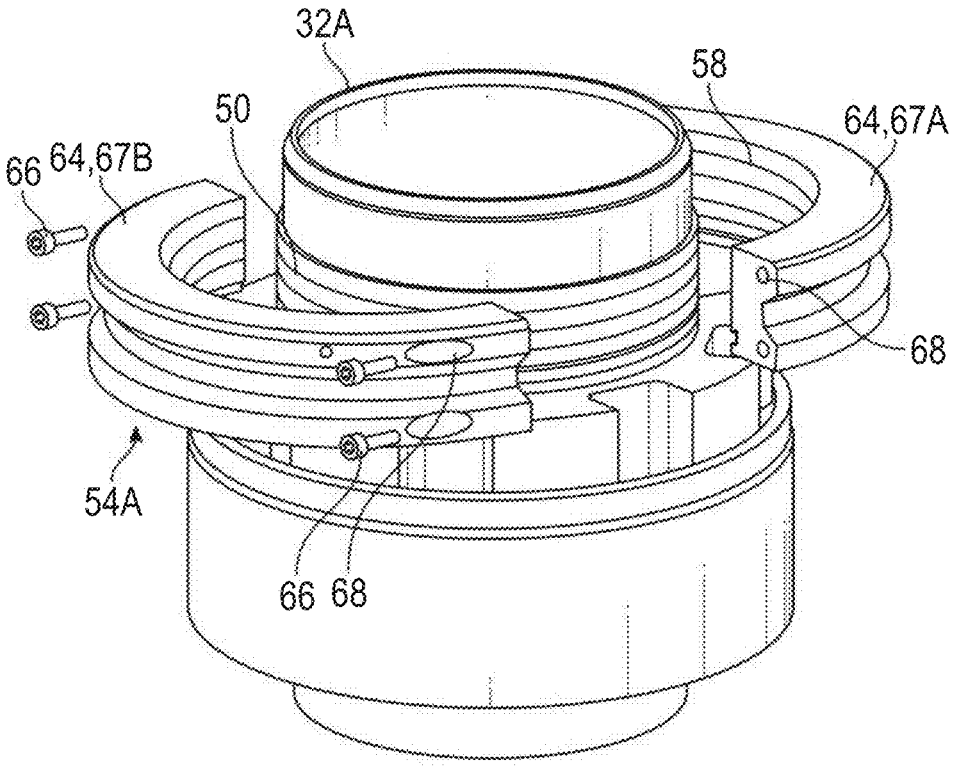
FIG. 4 is an exploded perspective view of an example of a retainer ring assembly that may facilitate securing a remainder of a wellhead to a casing hanger, in accordance with an embodiment of the present disclosure.

To help illustrate, an example of a (e.g., two-piece) retainer ring assembly 54A that may be deployed in a wellhead 14 is shown in FIG. 4. As depicted, the retainer ring assembly 54A includes multiple ring segments 64—namely a first threaded ring segment 67A and a second threaded ring segment 67B—that include internal ring threading 58, which is implemented (e.g., positioned, sized, and/or shaped) to interlock with external hanger threading 50 on a surface casing hanger 32A. To facilitate securing the threaded ring segments 67 to one another, in the depicted example, the retainer ring assembly 54A includes transverse (e.g., tangential) securement (e.g., threaded) fasteners (e.g., screws or bolts) 66, which are each implemented to be secured in corresponding transverse fastener (e.g., threaded) openings 68 in the threaded ring segments 67.

In fact, as in the depicted example, implementing a retainer ring assembly 54 with multiple ring segments 64 may enable the ring segments 64 to be assembled directly around a corresponding casing hanger 32, for example, as compared to screwing the retainer ring assembly 54 onto the casing hanger 32. At least in some instances, assembling ring segments 64 of a retainer ring assembly 54 directly around a casing hanger 32 may facilitate easing installation, for example, by reducing the mass that needs to be rotated.

Nevertheless, it should be appreciated that the depicted example is merely intended to be illustrative and not limiting. In particular, in other embodiments, a retainer ring assembly 54 in a wellhead 14 may include more than two (e.g., three, four, or more) ring segments 64.

In any case, returning to FIG. 2, as depicted, the retainer ring assembly 54 includes an external retainer groove (e.g., notch) 70 and each radial retainer fastener 56 is secured in a corresponding radial fastener (e.g., threaded) opening 72 in the casing head 36 and has an inner (e.g., tapered) end, which is implemented (e.g., positioned, shaped, and/or sized) to extend beyond its corresponding radial fastener opening 72 into the external retainer groove 70 on the retainer ring assembly 54 such that the radial retainer fastener 56 interlocks with the external retainer groove 70 and, thus, axially overlaps with the retainer ring assembly 54. Accordingly, when secured through a radial fastener opening 72 in the casing head 36 such that its inner end interlocks with the external retainer groove 70 on the retainer ring assembly 54, a radial retainer fastener 56 may facilitate securing the casing head 36 and, thus, a remainder of a wellhead 14 to the retainer ring assembly 54 and, thus, a corresponding surface casing hanger 32A. In other words, using a retainer ring assembly 54 and one or more radial retainer fasteners 56 in a wellhead 14 may enable external hanger threading 50 on a casing hanger 32, which is used to manipulate the casing hanger 32 via a casing running tool, to be reused to facilitate securing a remainder of the wellhead 14 to the casing hanger 32.

Nevertheless, it should again be appreciated that the depicted example is merely intended to be illustrative and not limiting. In particular, to facilitate easing deployment, in other embodiments, an external retainer groove 70 and internal ring threading 58 of a retainer ring assembly 54 may be implemented using separate components.

Figure 5:
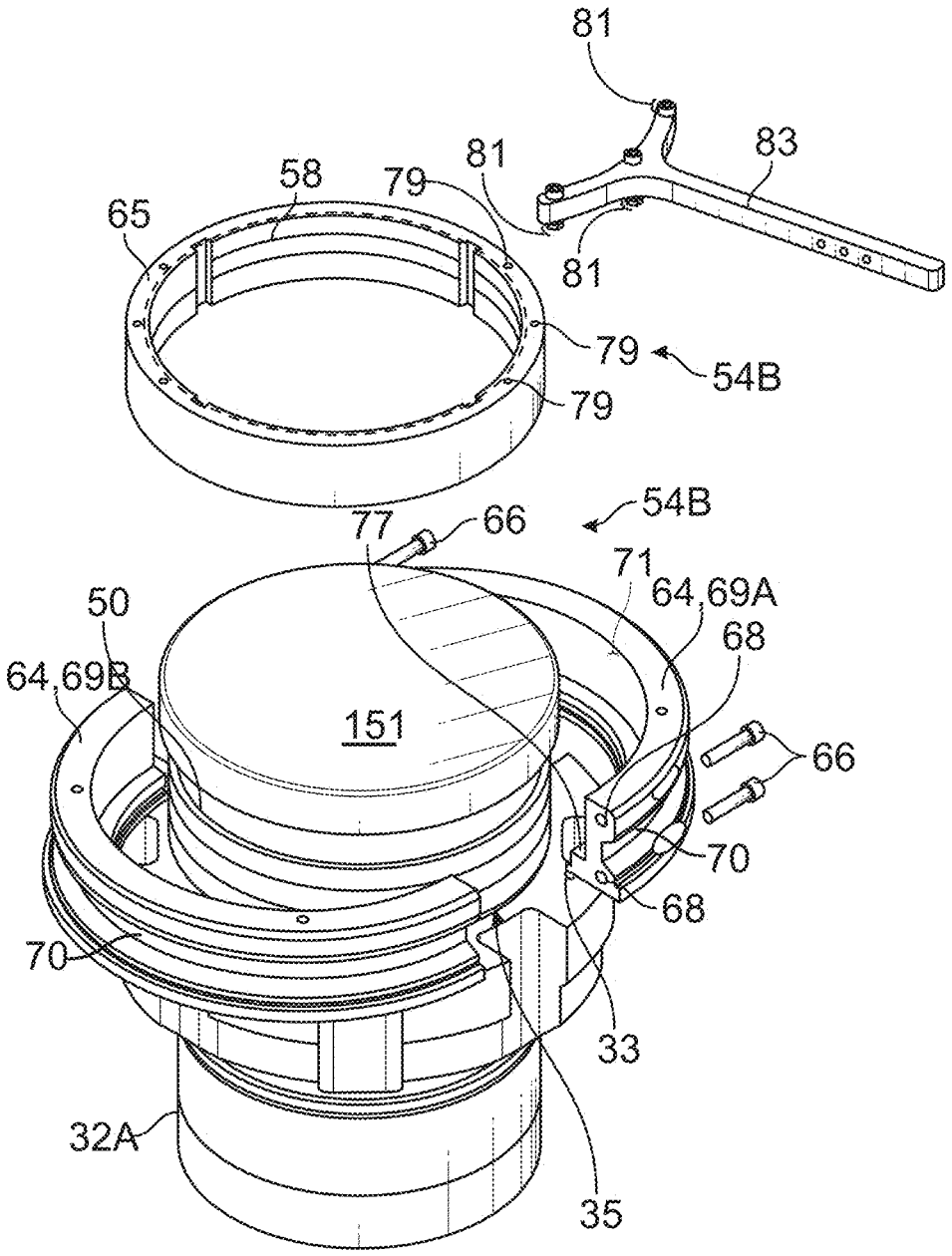
FIG. 5 is an exploded perspective view of another example of a retainer ring assembly that may facilitate securing a remainder of a wellhead to a casing hanger, in accordance with an embodiment of the present disclosure.

To help illustrate, another example of a (e.g., three-piece) retainer ring assembly 54B that may be deployed in a wellhead 14 is shown in FIG. 5. Similar to the retainer ring assembly 54A of FIG. 4, the retainer ring assembly 54B of FIG. 5 includes multiple ring segments 64 with its external retainer groove 70.

However, as depicted in FIG. 5, the ring segments 64 of the retainer ring assembly 54B do not include internal ring threading 58 and, thus, include a first unthreaded ring segment 69A and a second unthreaded ring segment 69B. Instead, the retainer ring assembly 54B includes internal ring threading 58, which is implemented (e.g., positioned, sized, and/or shaped) to interlock with external hanger threading 50 on a surface casing hanger 32A, on a separate threaded inner ring 65. Additionally, the unthreaded ring segments 69 are implemented (e.g., positioned, sized, and/or shaped) to axially overlap under the threaded inner ring 65, thereby using the weight of the surface casing hanger 32A and a corresponding surface casing string 26A to facilitate securing the threaded inner ring 65 against the unthreaded ring segments 69.

In the example depicted in FIG. 5, the unthreaded ring segments 69 define an internal ring recess 71, which accommodates the threaded inner ring 65. In particular, in the depicted example, the unthreaded ring segments 69 include a ring shoulder 77, which defines a lower end of the ring recess 71 and is implemented (e.g., positioned, sized, and/or shaped) to axially abut a lower end of the threaded inner ring 65. Additionally, in the depicted example, the ring recess 71 is defined to enable the unthreaded ring segments 69 to radially abut the threaded inner ring 65, for example, to facilitate maintaining centralization of the threaded inner ring 65 and, thus, a corresponding casing hanger 32. Furthermore, in the depicted example, the ring recess 71 is defined with an open upper end, for example, to enable the threaded inner ring 65 to be secured to the surface casing hanger 32A after the unthreaded ring segments 69. Accordingly, as in the depicted example, to facilitate securing a threaded inner ring 65 to a surface casing hanger 32A after corresponding unthreaded ring segments 69, in some embodiments, an upper end of the threaded inner ring 65 may include one or more wrench openings 79, which are each implemented (e.g., positioned, sized, and/or shaped) to interlock with a corresponding wrench protrusion 81 on a spanner wrench 83.

However, it should be appreciated that the depicted example is merely intended to be illustrative and not limiting. In particular, in other embodiments, a threaded inner ring 65 in a retainer ring assembly 54 may be secured to a casing hanger 32 before corresponding unthreaded ring segments 69. Additionally, in other embodiments, a ring recess 71 may be defined in unthreaded ring segments 69 of a retainer ring assembly 54 with a different shape, for example, with a closed upper end when a corresponding threaded inner ring 65 is to be secured to a casing hanger 32 before the unthreaded ring segments 69. Alternatively, in other embodiments, unthreaded ring segments 69 in a retainer ring assembly 54 may not define a ring recess 71, for example, when a corresponding threaded inner ring 65 is to be disposed completely on top of the unthreaded ring segments 69 and/or an outer diameter of the threaded inner ring 65 snuggly fits within an inner diameter of a corresponding casing head 36.

In any case, similar to the threaded ring segments 67 of FIG. 4, to facilitate securing the unthreaded ring segments 69 to one another, the retainer ring assembly 54B of FIG. 5 includes transverse securement fasteners 66, which are each implemented to be secured in corresponding transverse fastener openings 68 in the unthreaded ring segments 69. Additionally, similar to the threaded ring segments 67 of FIG. 4, to facilitate securement of a casing head 36 and, thus, a remainder of a wellhead 14 thereto, the unthreaded ring segments 69 of FIG. 5 include an external retainer groove 70 that extends circumferentially therearound.

However, to facilitate securement to the surface casing hanger 32A, the unthreaded ring segments 69 of FIG. 5 include an internal retainer protrusion (e.g., tab) 33, which is implemented (e.g., positioned, sized, and/or shaped) to interlock with an external retainer notch (e.g., groove) 35 on the surface casing hanger 32A. Additionally, as in the depicted example, in some embodiments, a cap 151 may be used to cover an upper open end of a casing hanger 32 during deployment (e.g., installation and/or securement) of a corresponding retainer ring assembly 54, for example, to facilitate blocking inadvertent contamination of a corresponding wellbore 20 and/or inadvertent leakage from the wellbore 20.

However, it should again be appreciated that the depicted example is merely intended to be illustrative and not limiting. In particular, in other embodiments, a cap 151 may not be used to cover an upper open end of a surface casing hanger 32A during deployment of a corresponding retainer ring assembly 54. Additionally, in other embodiments, a retainer ring assembly 54 in a wellhead 14 may include one or more external retainer grooves 70 that each extends partially around its circumference, for example, to facilitate limiting (e.g., blocking) rotation between the retainer ring assembly 54 and a corresponding casing head 36. Furthermore, in other embodiments, unthreaded ring segments 69 of a retainer ring assembly 54 may additionally or alternatively include an internal retainer notch 62, which is implemented (e.g., positioned, sized, and/or shaped) to interlock with an external retainer protrusion 60 on a casing hanger 32. Moreover, instead of multiple ring segments 64, in other embodiments, a retainer ring assembly 54 in a wellhead 14 may include a continuous ring and, thus, not include transverse securement fasteners 66 or transverse fastener openings 68.

Figure 6:
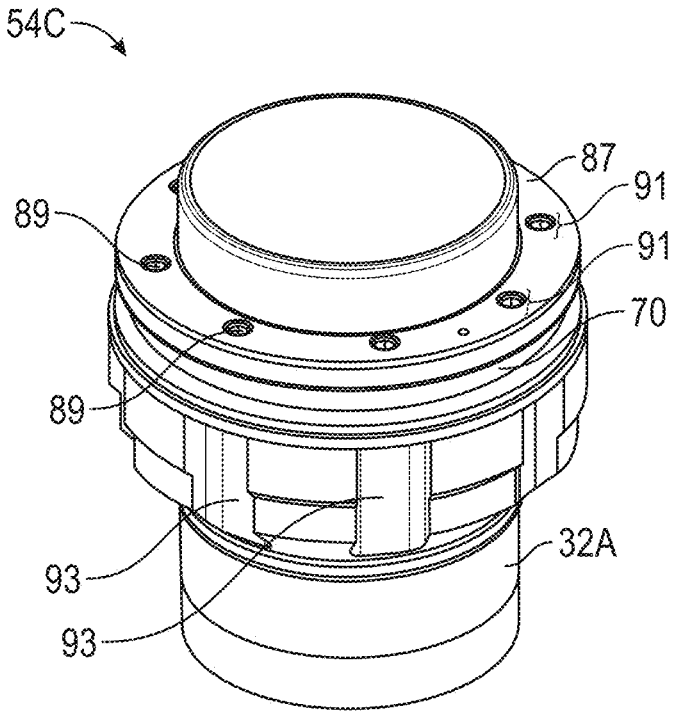
FIG. 6 is a perspective view of a further example a retainer ring assembly that may facilitate securing a remainder of a wellhead to a casing hanger, in accordance with an embodiment of the present disclosure.

To help illustrate, a further example of a retainer ring assembly 54C that may be deployed in a wellhead 14 is shown in FIG. 6. As depicted, the retainer ring assembly 54C includes a threaded retainer ring 87 with its external retainer groove 70. Additionally, although obfuscated from view, the threaded retainer ring 87 includes internal ring threading 58, which is interlocked with external hanger threading 50 on a surface casing hanger 32A.

To facilitate blocking inadvertent rotation and, thus, inadvertent axial movement, in the depicted example, the retainer ring assembly 54C includes axial anti-rotation (e.g., threaded and/or upper) fasteners (e.g., screws and/or bolts) 89 secured downwardly within axial fastener (e.g., threaded and/or upper) openings 91 in the threaded retainer ring 87. However, it should be appreciated that the depicted example is merely intended to be illustrative and not limiting. In particular, in other embodiments, a retainer ring assembly 54 may include more than eight (e.g., nine, ten, or more) axial anti-rotation fasteners 89 or fewer than eight (e.g., seven, six, or less) anti-rotation fasteners 89.

In any case, as in the depicted example, in some embodiments, a threaded retainer ring 87 may be secured to a casing hanger 32 such that a corresponding axial anti-rotation fastener 89 is axially aligned with a fluid circulation flute 93 in the casing hanger 32. Accordingly, in some such embodiments, tightening the axial anti-rotation fastener 89 such that its lower end extends beyond the threaded retainer ring 87 into the fluid circulation flute 93 may limit (e.g., block) rotation between the threaded retainer ring 87 and the casing hanger 32. However, to facilitate blocking inadvertent rotation, in other such embodiments, the axial anti-rotation fastener 89 may be tightened to press a retainer plate against an opposing hanger shoulder on the casing hanger 32.

Figure 7:
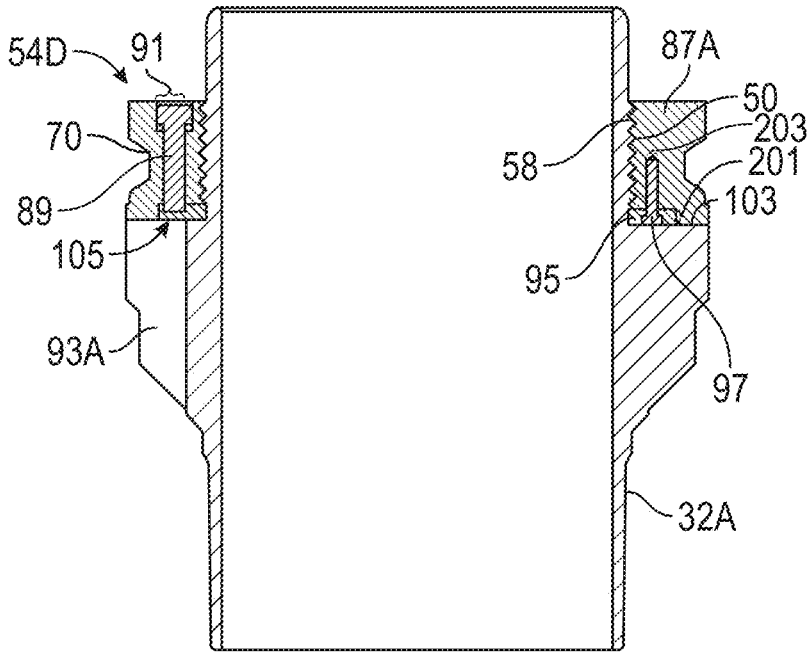
FIG. 7 is a side cross-sectional view of another example of a retainer ring assembly that may facilitate securing a remainder of a wellhead to a casing hanger, in accordance with an embodiment of the present disclosure.

To help illustrate, another example of a retainer ring assembly 54D that may be deployed in a wellhead 14 is shown in FIG. 7. As depicted, the retainer ring assembly 54D includes a threaded retainer ring 87A with an external retainer groove 70 and internal ring threading 58, which is interlocked with external hanger threading 50 on a surface casing hanger 32A. Additionally, as depicted, the retainer ring assembly 54D includes an axial anti-rotation fastener 89 secured downwardly within an upper axial fastener opening 91 such that it is axially aligned with a fluid circulation flute 93 in the surface casing hanger 32A.

To facilitate blocking inadvertent rotation, as depicted, the retainer ring assembly 54D additionally includes a retainer plate 95, which is secured to the threaded retainer ring 87A via an axial securement (e.g., lower and/or threaded) fastener (e.g., screw or bolt) 97 secured upwardly through the retainer plate 95 into a lower axial fastener (e.g., threaded) opening 203 in the threaded retainer ring 87A. In particular, in the depicted example, the retainer plate 95 is disposed within a plate recess 201 defined in the threaded retainer ring 87A such that the retainer plate 95 is disposed directly under the axial anti-rotation fastener 89. Accordingly, in the depicted example, tightening the axial anti-rotation fastener 89 may press the retainer plate 95 against an opposing hanger shoulder 103 on the surface casing hanger 32A and, thus, facilitate resisting (e.g., limiting and/or blocking) inadvertent rotation between the retainer ring assembly 54D and the surface casing hanger 32A. In fact, when axially aligned with a fluid circulation flute 93 formed in the hanger shoulder 103, tightening the axial anti-rotation fastener 89 may axially deform the retainer plate 95 into the fluid circulation flute 93, which, at least in some instances, facilitates further increasing resistance to inadvertent rotation.

However, it should be appreciated that the depicted example is merely intended to be illustrative and not limiting. In particular, in some instances, an axial anti-rotation fastener 89 in a retainer ring assembly 54 may not be axially aligned with a fluid circulation flute 93 in a corresponding casing hanger 32 and may instead be axially aligned with a hanger shoulder 103 on the casing hanger 32. Additionally, in other embodiments, a retainer ring assembly 54 may includes a threaded retainer ring 87 and an axial anti-rotation fastener 89 but not a retainer plate 95, for example, to enable the axial anti-rotation fastener 89 to extend beyond the threaded retainer ring 87 into a fluid circulation flute 93 in a corresponding casing hanger 32 or another (e.g., fastener) opening in a hanger shoulder 103 of the casing hanger 32. Furthermore, in other embodiments, a retainer plate 95 in a retainer ring assembly 54 may not be secured within a plate recess 201 in a corresponding threaded retainer ring 87A, for example, instead being secured completely under the threaded retainer ring 87.

In any case, to facilitate increasing resistance to inadvertent rotation, in some embodiments, a lower (e.g., bottom) surface 105 of a retainer plate 95 in a retainer ring assembly 54 may be contoured. For example, in some such embodiments, the lower surface 105 of a retainer plate 95 may include serrations. As another example, in some such embodiments, the lower surface 105 of a retainer plate 95 may include radial wedges.

Figure 8:
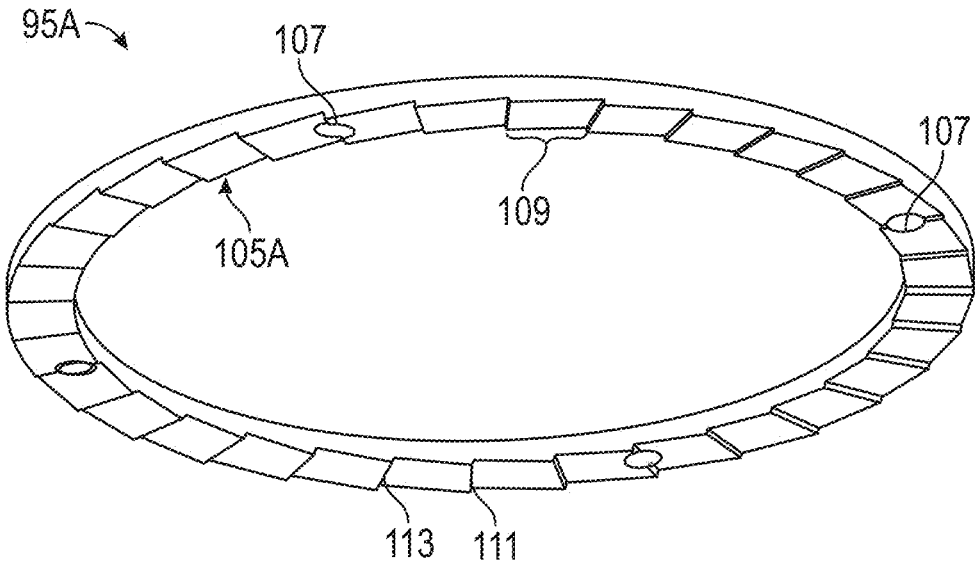
FIG. 8 is a perspective view of a retainer plate that may be included in the retainer ring assembly of FIG. 7, in accordance with an embodiment of the present disclosure.

To help illustrate, an example of a retainer plate 95A that may be included in a retainer ring assembly 54 is shown in FIG. 8. As depicted, to facilitate securement to a corresponding threaded retainer ring 87, the retainer plate 95A includes axial fastener openings 107, which are each implemented to accommodate a corresponding axial securement fastener 97 and to be axially aligned with a corresponding lower axial fastener opening 203 in the threaded retainer ring 87.

However, it should be appreciated that the depicted example is merely intended to be illustrative and not limiting. In particular, in other embodiments, a retainer plate 95 in a retainer ring assembly 54 may include more than four (e.g., five, six, or more) axial fastener openings 107, for example, when the retainer ring assembly 54 includes more than four (e.g., five, six, or more) axial securement fasteners 97. Alternatively, in other embodiments, a retainer plate 95 in a retainer ring assembly 54 may include fewer than four (e.g., three, two, or fewer) axial fastener openings 107, for example, when the retainer ring assembly 54 includes fewer than four (e.g., three, two, or fewer) axial securement fasteners 97.

In any case, in the depicted example, the lower surface 105A of the retainer plate 95A is contoured to have radial wedges 109. In particular, the radial wedges 109 on the lower surface 105A of the retainer plate 95A each includes a protruding corner 111 that tapers in a counter-clockwise direction to a recessed corner 113, for example, due to internal ring threading 58 on a corresponding threaded retainer ring 87 and external hanger threading 50 on a corresponding casing hanger 32 being left hand threaded. Accordingly, when pressed against an opposing hanger shoulder 103 on a casing hanger 32, the protruding corners 111 on the retainer plate 95A may bite into the hanger shoulder 103 of the casing hanger 32 and, thus, resist counter-clockwise (e.g., loosening) rotation.

However, it should be appreciated that the depicted example is merely intended to be illustrative and not limiting. In particular, in other embodiments, the lower surface 105 of a retainer plate 95 in a retainer ring assembly 54 may be contoured with a different shape. As an example, in other embodiments, the lower surface 105 of a retainer plate 95 may have radial wedges that each includes a protruding corner 111 that tapers in a clockwise direction to a recessed corner 113, for example, due to internal ring threading 58 on a corresponding threaded retainer ring 87 and external hanger threading 50 on a corresponding casing hanger 32 being right hand threaded. As another example, in other embodiments, the lower surface 105 of a retainer plate 95 may have radial wedges that each includes a (e.g., central) protruding corner 111 that tapers to a first recessed corner 113 in a counter-clockwise direction and to a second recessed corner 113 in a clockwise direction.

In any case, returning to FIG. 2, as described above, after a retainer ring assembly 54 is secured to the surface casing hanger 32A, a radial retainer fastener 56 may be secured through a radial fastener opening 72 in a casing head 36 such that its inner end interlocks with an external retainer groove 70 on the retainer ring assembly 54. In this manner, a retainer ring assembly 54 in a wellhead 14 may enable external hanger threading 50 on a casing hanger 32, which is used to manipulate the casing hanger 32 via a corresponding casing running tool, to be reused to facilitate securing a remainder of the wellhead 14 to the casing hanger 32.

Nevertheless, it again should be appreciated that the depicted example is merely intended to be illustrative and not limiting. In particular, in other embodiments, a casing head 36 of a wellhead 14 and, thus, a remainder of the wellhead 14 may be secured around a central portion 57 of a surface casing hanger 32A below its external hanger threading 50 and, thus, the casing head 36 may need to extend down to the central portion 57 of the surface casing hanger 32A. However, at least in some instances, reusing external hanger threading 50 on a casing hanger 32 of a wellhead 14 to secure a casing head 36 and, thus, a remainder of the wellhead 14 to the casing hanger 32 may facilitate reducing height and, thus, material and/or weight of the casing head 36 and/or the casing hanger 32, for example, since the central portion 57 of the casing hanger 32 no longer needs to accommodate a retainer assembly and/or since the casing head 36 no longer needs to extend down to the central portion 57 of the casing hanger 32.

In any case, after the casing head 36 is secured to the surface casing hanger 32A, the intermediate casing hanger 32B and, thus, a corresponding intermediate casing string 26B may be landed in the casing head 36. To facilitate fluidly isolating (e.g., sealing) an intermediate annulus 30B surrounding the intermediate casing string 26B, as in the depicted example, a wellhead 14 may include an intermediate packoff 74A, which lands within its casing head 36 above a corresponding intermediate casing hanger 32B. In particular, the intermediate packoff 74A generally includes an intermediate packoff body 73A, which defines an intermediate packoff bore 75A that extends therethrough, one or more external intermediate packoff seals 76A, which are each implemented to be radially compressed between the intermediate packoff body 73A and the casing head 36, as well as one or more internal intermediate packoff seals 78A, which are each implemented to be radially compressed between the intermediate packoff body 73A and the intermediate casing hanger 32B.

To facilitate selective securement to the casing head 36, in the depicted example, the intermediate packoff 74A additionally includes an intermediate lockring assembly 80A. In particular, in the depicted example, the intermediate lockring assembly 80A includes an inwardly-biased intermediate lockring 82A, and an intermediate activation (e.g., energizer) ring 85A, which facilitates selectively transitioning the inwardly-biased intermediate lockring 82A between a contracted (e.g., unsecured, deactivated, and/or unlocked) state and an expanded (e.g., secured, activated, and/or locked) state, which is shown in FIG. 2. More specifically, in the depicted example, while in its expanded state, the inwardly-biased intermediate lockring 82A of the intermediate packoff 74A is disposed within the internal intermediate lockring groove 84A in the casing head 36 such that the inwardly-biased intermediate lockring 82A axially overlaps with the casing head 36, thereby securing the intermediate packoff 74A to the casing head 36 and, thus, within the wellhead 14A.

Additionally, as in the depicted example, to enable fluid flow therethrough, in some embodiments, a casing head 36 of a wellhead 14 may include an outlet port (e.g., opening) 131 while a corresponding intermediate packoff 74A may include a flow-by port (e.g., opening) 133. In particular, in some embodiments, an outlet port 131 in a casing head 36 and a flow-by port 133 in an intermediate packoff 74A may facilitate extracting fluid, such as drilling mud, from an inner annulus 30C surrounding a production casing string 26C, for example, while the production casing string 26C is being cemented. Additionally, in some embodiments, an outlet port 131 in a casing head 36 and a flow-by port 133 in an intermediate packoff 74A may facilitate pressurizing an inner annulus 30C surrounding a production casing string 26C, for example, during hydraulic fracturing to facilitate blocking the production casing string 26C from inadvertently expanding (e.g., ballooning). In any case, as in the depicted example, to facilitate increasing (e.g., maximizing) fluid flow therethrough, in some embodiments, the cross-sectional shape of a flow-by port 133 in an intermediate packoff 74A may not match the cross-sectional shape of a corresponding outlet port 131 in a casing head 36.

Figure 9:
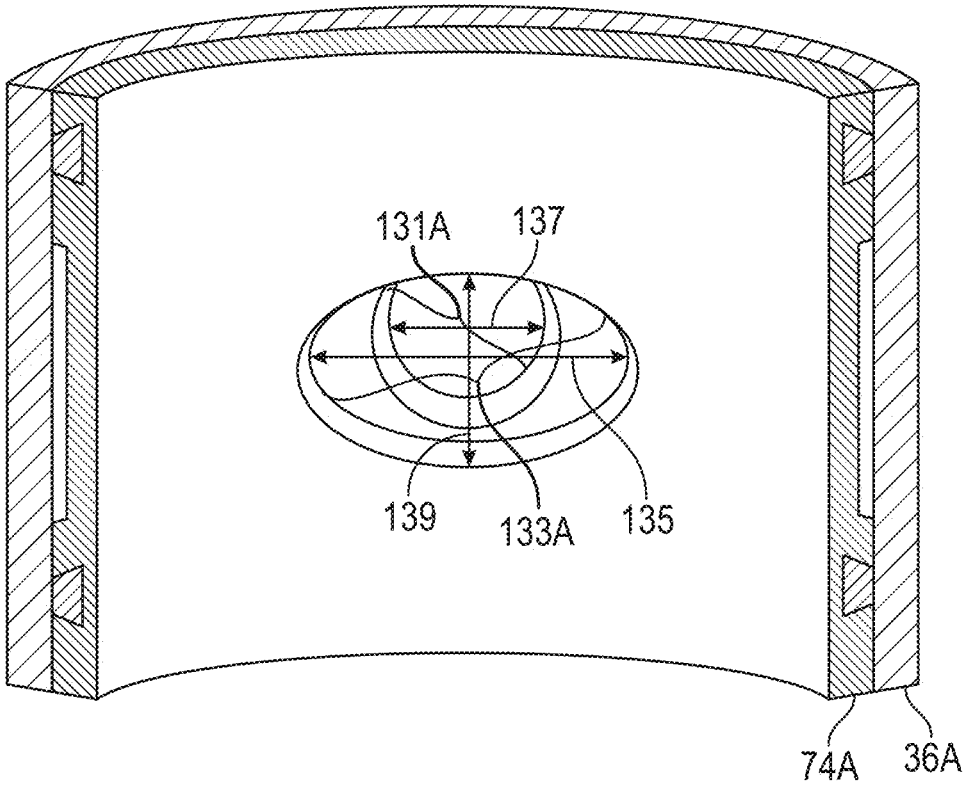
FIG. 9 is a perspective view of an example of a portion of an intermediate (e.g., outer) packoff and a casing head that may be included in a wellhead, in accordance with an embodiment of the present disclosure.

To help more clearly illustrate, an example of a portion of an intermediate packoff 74A and a portion of a casing head 36A is shown in FIG. 9. As depicted, the casing head 36A includes a circular-shaped outlet port 131A that opens therethrough while the intermediate packoff 74A includes an oval-shaped flow-by port 133A that opens therethrough. In particular, in the depicted example, the major axis 135 of the oval-shaped flow-by port 133A is greater (e.g., larger and/or wider) than the diameter 137 of the circular-shaped outlet port 131A, for example, while the minor axis 139 of the oval-shaped flow-by port 133A is greater (e.g., larger and/or taller) than or equal to (e.g., matches) the diameter 137 of the circular-shaped outlet port 131A.

Accordingly, when slightly misaligned radially (e.g., horizontally), more of the oval-shaped flow-by port 133A may overlap with the circular-shaped outlet port 131A as compared to a circular-shaped flow-by port 133 that would otherwise be included at the same position in the intermediate packoff 74A and, thus, facilitate increasing (e.g., maximizing) fluid flow therethrough, for example, due to the minor axis 139 of the oval-shaped flow-by port 133A matching the diameter 137 of the circular-shaped flow-by port 133 while the major axis 135 of the oval-shaped flow-by port 133A is greater than the diameter 137 of the circular-shaped flow-by port 133 and, thus, the cross-sectional area of the oval-shaped flow-by port 133A being larger than the circular-shaped flow-by port 133. In fact, at least in some instances, an oval-shaped flow-by port 133A in an intermediate packoff 74A may increase fluid flow therethrough as compared to a circular-shaped flow-by port 133 even when completely misaligned (e.g., does not overlap) with an outlet port 131 in a corresponding casing head 36.

However, it should be appreciated that the depicted example is merely intended to be illustrative and not limiting. In particular, in other embodiments, a flow-by port 133 in an intermediate packoff 74A may have a different shape, for example, a circular shape, a rectangular shape, a hexagonal shape, or an octagonal shape. Additionally or alternatively, in other embodiments, an outlet port 131 in a casing head 36 may have a different shape, for example, an oval shape, a rectangular shape, a hexagonal shape, or an octagonal shape.

In any case, returning to FIG. 2, to facilitate suspending a production casing string 26C concentrically with a surface casing string 26A and an intermediate casing string 26B, as in the depicted example, a wellhead 14 may include a production (e.g., inner) casing hanger 32C, which is implemented to land within its casing head 36 and to be secured to an upper end of the production casing string 26C. Although described as supporting and suspending a production casing string 26C, in other embodiments, a production casing hanger 32C may instead be used to support and suspend a production tubing string 18 within a wellbore 20 and, thus, may be used as a tubing hanger, for example, to obviate a separate tubing head and tubing hanger when fewer than three (e.g., two or one) casing strings 26 are used.

In any case, in the depicted example, the production casing hanger 32C is a multi-piece casing hanger 32, which includes a hanger body 88C and a separate support ring 86. In particular, to suspend the production casing hanger 32C within the wellhead 14A, the support ring 86 defines an external landing shoulder 90C, which is implemented (e.g., positioned, sized and/or shaped) to land on an internal landing shoulder 92C in the intermediate packoff 74A, for example, in addition to a fluid circulation flute 93B. Additionally, the hanger body 88C defines a hanger bore 94C, which extends therethrough, and a body shoulder 117, which is implemented (e.g., positioned, sized, and/or shaped) to land on the support ring 86 such that hanger body 88C extends therethrough. Accordingly, to facilitate suspending a production casing string 26C within the wellbore 20, the lower end of the hanger body 88C may be secured to an upper end of the production casing string 26C.

As in the depicted example, to facilitate securing a support ring 86 of a casing hanger 32 to a corresponding hanger body 88, in some embodiments, the hanger body 88 may include external body threading 98 while the support ring 86 may include internal ring threading 96, which is implemented (e.g., positioned, sized, and/or shaped) to interlock with the external body threading 98 on the hanger body 88. Accordingly, in such embodiments, the support ring 86 may be secured to the hanger body 88 at least in part by rotating the support ring 86 in a first (e.g., right and/or clockwise) direction relative to the hanger body 88 to interlock the internal ring threading 96 on the support ring 86 with the external body threading 98 on the hanger body 88. On the other hand, the support ring 86 may be disconnected (e.g., removed) from the hanger body 88 at least in part by rotating the support ring 86 in a second (e.g., left, counter-clockwise, and/or opposite) direction relative to the hanger body 88 such that the internal ring threading 96 on the support ring 86 disengages from the external body threading 98 on the hanger body 88. In other words, in such embodiments, the support ring 86 may be selectively secured to the hanger body 88.

In fact, in some embodiments, implementing a casing hanger 32 using a hanger body 88 and a separate support ring 86 may enable the same hanger body 88 to be used with different internal landing shoulder geometries (e.g., shapes and/or diameters) and, thus, different wellhead types and/or configurations simply by swapping out the support ring 86. For example, to land a casing hanger 32 on an internal landing shoulder 92 with a larger inner diameter, a first support ring 86, which has an external landing shoulder 90 with a larger outer diameter, may be secured to its hanger body 88 and, to land the casing hanger 32 on an internal landing shoulder 92 with a smaller inner diameter, a second support ring 86, which has an external landing shoulder 90 with a smaller outer diameter, may be secured to its hanger body 88.

Additionally, implementing a casing hanger 32 using a hanger body 88 and a separate support ring 86 may enable the hanger body 88 and the support ring 86 to be formed using different materials, which, at least in some instances, may facilitate optimizing implementation-associated (e.g., material and/or manufacturing) costs. In particular, since fluid flow will primarily be through its hanger bore 94, a hanger body 88 of a casing hanger 32 may be formed using a more exotic material (e.g., to better handle corrosive fluid) while a corresponding support ring 86 may be formed using a less exotic material. For example, a hanger body 88 of a casing hanger 32 may be formed using stainless steel while a corresponding support ring 86 is formed using carbon steel.

However, it should again be appreciated that the depicted example is merely intended to be illustrative and not limiting. In particular, in other embodiments, a surface casing hanger 32A and/or an intermediate casing hanger 32B in a wellhead 14 may implemented using a hanger body 88 and a separate support ring 86 in an analogous manner. Alternatively, in other embodiments, a hanger body 88 of a production casing hanger 32C may define its hanger bore 94 as well as its external landing shoulder 90 and, thus, the production casing hanger 32C may not include a separate support ring 86.

In any case, as in the depicted example, to facilitate securing a valve tree 16 or another wellhead component (e.g., tubing head) to a casing head 36, a securement component 37 may be secured to an upper end of the casing head 36. In particular, in the depicted example, the securement component 37 is a flange 37A, which includes internal flange threading 39A that is implemented (e.g., positioned, sized, and/or shaped) to interlock with external head threading 41 at an upper end of the casing head 36. Accordingly, the flange 37A may be secured to the casing head 36 at least in part by rotating the flange 37A in a first (e.g., right and/or clockwise) direction relative to the casing head 36 to interlock the internal flange threading 39A on the flange 37A with the external head threading 41 on the casing head 36. On the other hand, the flange 37A may be removed (e.g., disconnected) from the casing head 36 at least in part by rotating the flange 37A in a second (e.g., left, counter-clockwise, and/or opposite) direction relative to the casing head 36 to disengage the internal flange threading 39A on the flange 37A from the external head threading 41 on the casing head 36.

In other words, in such embodiments, a securement component 37, such as a flange 37A, may be selectively secured to a casing head 36. In fact, in some embodiments, different securement components 37 may be used with the same casing head 36 at different times.

Figure 10:
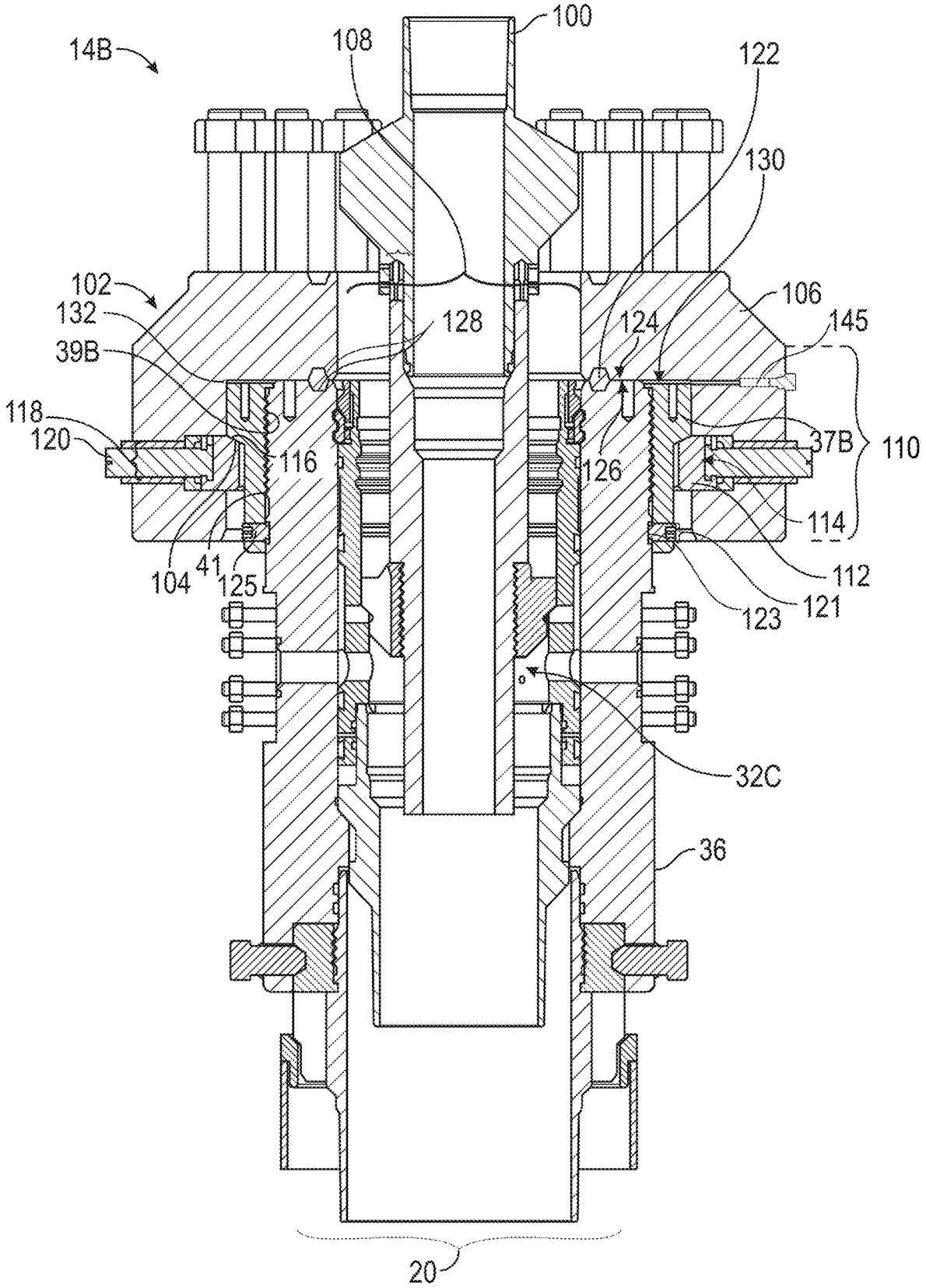
FIG. 10 is a side cross-sectional view of another example of a wellhead that may be deployed in the well system of FIG. 1, in accordance with an embodiment of the present disclosure.

To help illustrate, another example of a wellhead 14B is shown in FIG. 10. The wellhead 14B of FIG. 10 generally matches the wellhead 14A of FIG. 2 except that the wellhead 14B of FIG. 10 is shown during deployment of the production casing hanger 32C and, thus, during drilling of the wellbore 20.

Accordingly, instead of a flange 37A, in the depicted example, a different securement component 37—namely a threaded hub 37B—is secured to the casing head 36 to facilitate securing another wellhead component—namely a drilling adapter 102—to the casing head 36. In particular, in the depicted example, the threaded hub 37B includes internal hub threading 39B, which is implemented (e.g., positioned, sized, and/or shaped) to interlock with external head threading 41 on the casing head 36. Accordingly, the threaded hub 37B may be secured to the casing head 36 at least in part by rotating the threaded hub 37B in a first (e.g., right and/or clockwise) direction relative to the casing head 36 to interlock the internal hub threading 39B on the threaded hub 37B with the external head threading 41 on the casing head 36. On the other hand, the threaded hub 37B may be removed (e.g., disconnected) from the casing head 36 at least in part by rotating the threaded hub 37B in a second (e.g., left, counter-clockwise, and/or opposite) direction relative to the casing head 36 to disengage the internal hub threading 39B on the threaded hub 37B from the external head threading 41 on the casing head 36.

Accordingly, in some embodiments, different securement components 37 may be selectively secured to a casing head 36, for example, at different times. Merely as an illustrative, non-limiting example, a threaded hub 37B may be secured to a casing head 36 to facilitate securing a drilling adapter 102 thereto during drilling and, subsequently, a flange 37A may be secured to the casing head 36 to facilitate securing another wellhead component, such as a tubing head, or a valve tree 16, thereto during fluid production.

To facilitate selectively securing the drilling adapter 102 thereto and, thus, to the casing head 36, in the depicted example, the threaded hub 37B includes an external, downwardly-facing, male-tapered surface 104. Additionally, in the depicted example, the drilling adapter 102 includes an adapter body 106, which defines an adapter bore 108 and has a side portion 110 that extends downwardly, a clamp ring 112, which has an internal, upwardly-facing, female-tapered surface 116 and is disposed within a ring cavity (e.g., notch and/or groove) 114 in the side portion 110 of the adapter body 106 below the external, downwardly-facing, male-tapered surface 104 of the threaded hub 37B, and radial clamp fasteners (e.g., screws and/or bolts) 120, which each extends radially through a corresponding radial fastener (e.g., threaded) opening 118 in the side portion 110 of the adapter body 106 such that it abuts the clamp ring 112.

Accordingly, tightening a radial clamp fastener 120 (e.g., at least in by rotating in a first direction relative to the adapter body 106) may push the clamp ring 112 radially inward such that more of the clamp ring 112 axially opposes the threaded hub 37B, thereby facilitating securement of the drilling adapter 102 to the threaded hub 37B and, thus, the casing head 36. On the other hand, loosening a radial clamp fastener 120 (e.g., at least in part by rotating in a second/opposite direction relative to the adapter body 106) may enable the clamp ring 112 to expand radially outward such that less of the clamp ring 112 axially opposes the threaded hub 37B, thereby enabling the drilling adapter 102 to be disconnected (e.g., removed) from the threaded hub 37B and, thus, the casing head 36.

However, it should be appreciated that the depicted example is merely intended to be illustrative and not limiting. In particular, in other embodiments, a threaded hub 37B may be used to selectively secure other wellhead components, such as a cap assembly, to a corresponding casing head 36.

In any case, as in the depicted example, to facilitate sealing a connection between a casing head 36 and another wellhead component or a valve tree 16, a wellhead 14 may include one or more face seals 122, which are each implemented to be axially compressed between an (e.g., upper) end face 124 of the casing head 36 and another (e.g., lower and/or opposing) end face 126 of the other wellhead component or valve tree 16. In particular, to facilitate holding a face seal 122 in place and/or appropriately compressing the face seal 122, in the depicted example, the face seal 122 is disposed within corresponding face seal grooves 128 in the end face 124 of the casing head 36 and the other end face 126 of the other wellhead component or valve tree 16. Additionally, to facilitate appropriately compressing a face seal 122, in the depicted example, the securement component 37 (e.g., threaded hub 37B) is secured to the casing head 36 such that an end face 130 of the securement component 37 is recessed relative to (e.g., lower than) the end face 124 of the casing head 36, for example, to produce a gap 132 between the end face 130 of the securement component 37 and the other end face 126 of the other wellhead component or valve tree 16, which, at least in some instances, facilitates ensuring that the end face 124 of the casing head 36 directly abuts the other end face 126 of the other wellhead component or valve tree 16 and, thus, appropriate compression of the face seal 122.

Figure 11:
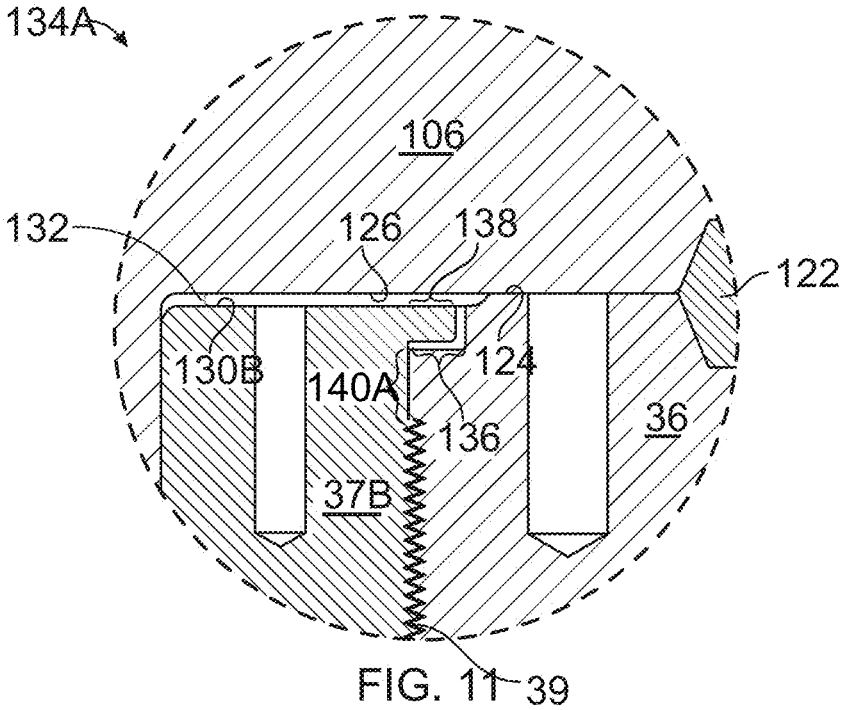
FIG. 11 is a close-up, cross-sectional view of an example of an interface between a casing head, a threaded hub, and a drilling adapter of a wellhead, in accordance with an embodiment of the present disclosure.

To help more clearly illustrate, a more detailed view of an example of an interface 134A between a casing head 36, a threaded hub 37B, and an adapter body 106 is shown in FIG. 11. As depicted, to facilitate appropriately compressing a face seal 122, the end face 124 of the casing head 36 directly abuts the end face 126 of the adapter body 106. Additionally, as depicted, to facilitate ensuring that the end face 124 of the casing head 36 directly abuts the end face 126 of the adapter body 106 and, thus, proper compression of the face seal 122, the threaded hub 37B is secured to the casing head 36 such that the end face 130B of the threaded hub 37B is recessed relative to (e.g., lower than) the end face 124 of the casing head 36, thereby producing a gap 132 between the end face 126 of the adapter body 106 and the end face 130B of the threaded hub 37B when the adapter body 106 is secured to the casing head 36 and, thus, reducing the likelihood of the threaded hub 37B inadvertently blocking the end face 126 of the adapter body 106 from directly abutting the end face 124 of the casing head 36.

In fact, as in the depicted example, to facilitate ensuring that an end face 130 of a securement component 37 is recessed relative to a corresponding end face 124 of a casing head 36, in some embodiments, an upper end of the casing head 36 may include an alignment groove (e.g., notch) 136 while an upper end of the securement component 37 may include an alignment protrusion (e.g., tab) 138, which extends radially inward and is implemented (e.g., positioned, shaped, and/or sized) to interlock with the alignment groove 136 in the casing head 36. Accordingly, in such embodiments, the securement component 37 may be tightened (e.g., rotated) on the casing head 36 until its alignment protrusion 138 directly abuts the casing head 36 within its alignment groove 136, which provides a hard stop that indicates when the securement component 37 has been sufficiently (e.g., fully) secured (e.g., tightened) on the casing head 36 to ensure proper face seal compression.

However, it should be appreciated that the depicted example is merely intended to be illustrative and not limiting. In particular, in some embodiments, a securement component 37, such as a threaded hub 37B, may be backed off slightly (e.g., less than a quarter rotation) once it reaches a hard stop on a corresponding casing head 36, for example, to facilitate aligning, as shown in FIG. 10, a radial fastener (e.g., threaded) opening 121 in the securement component 37 with a corresponding external anti-rotation notch (e.g., recess) 123 on the casing head 36 and, thus, securing a radial anti-rotation (e.g., threaded) fastener (e.g., screw or bolt) 125 through the radial fastener opening 121 in the securement component 37 into the external anti-rotation notch 123 on the casing head 36. Additionally, as shown in FIG. 2, the end face 130A of a flange 37A may similarly be recessed relative to a corresponding end face 124 of a casing head 36.

In any case, as in example shown in FIG. 11, at least in some instances, a relief (e.g., gap) 140A may be present between an alignment protrusion 138 and internal threading 39 on a securement component 37, for example, to provide space for tooling to transition from machining threads to machining a protrusion. Accordingly, in other embodiments, a securement component 37, such as a flange assembly or a threaded hub assembly, may include internal threading 39 on a body component and an alignment protrusion 138 on a separate component, for example, to enable the alignment protrusion 138 to be located closer to the internal threading 39 and, thus, shortening of the securement component 37 and/or a corresponding casing head 36.

Figure 12:
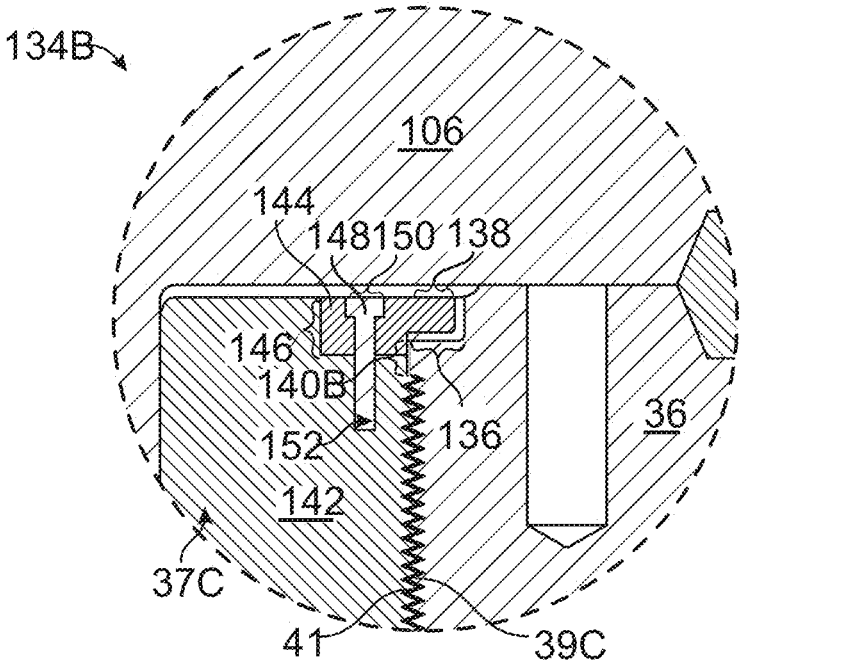
FIG. 12 is a close-up, cross-sectional view of another example of an interface between a casing head, a threaded hub assembly, and a drilling adapter of a wellhead, in accordance with an embodiment of the present disclosure.

To help illustrate, another example of an interface 134B between a casing head 36, a threaded hub assembly 37C, and an adapter body 106 is shown in FIG. 12. Similar to the threaded hub 37B of FIG. 11, the threaded hub assembly 37C of FIG. 12 includes internal threading 39C, which interlocks with external head threading 41 on the casing head 36, and an alignment protrusion 138, which directly abuts the casing head 36 within its alignment groove 136.

However, as depicted in FIG. 12, the internal threading 39C is implemented on a hub body 142 while the alignment protrusion 138 is implemented on a separate alignment ring 144. In particular, in the depicted example, the alignment ring 144 is secured within a ring notch (e.g., recess) 146 defined in the hub body 142 via an axial securement (e.g., threaded) fastener (e.g., screw or bolt) 148, which is secured through an axial fastener (e.g., threaded) opening 150 in the alignment ring 144 into an axial fastener (e.g., threaded) opening 152 in the hub body 142. By implementing using separate components, the alignment protrusion 138 and the internal threading 39 of a securement component 37 may be machined independent of one another, thereby enabling a smaller relief (e.g., gap) 140B between the alignment protrusion 138 and the internal threading 39, which, at least in some instances, may enable shortening the securement component 37 and/or a corresponding casing head 36 and, thus, reducing size and/or weight of the securement component 37 and/or the casing head 36.

Nevertheless, it should be appreciated that the depicted example is merely intended to be illustrative and not limiting. In particular, in other embodiments, a flange assembly 37 may include a flange body with its internal threading 39 and a separate alignment ring 144 with its alignment protrusion 138 in an analogous manner. Additionally, although a single axial securement fastener 148 is shown, multiple (e.g., two, three, or more) axial securement fasteners 148 may be used to secure an alignment ring 144 to a corresponding hub body 142 or flange body. Furthermore, in other embodiments, an alignment ring 144 may not be disposed within a ring notch 146 in a corresponding hub body 142 or flange body, for example, instead being disposed completely on top of the hub body 142 or flange body.

In any case, as in the example depicted in FIG. 10, in some embodiments, a wellhead 14 may include a test port 145 that opens to a face seal 122 to facilitate testing the face seal 122, for example, by enabling pressurized fluid to be supplied to the face seal 122 to test the pressure sealing capabilities (e.g., integrity) of the face seal 122. In particular, in the depicted example, the test port 145 opens through the side portion 110 of the drilling adapter 102.

However, it should again be appreciated that the depicted example is merely intended to be illustrative and not limiting. In particular, in other embodiments, an end face 130 of a securement component 37 may be further recessed relative to an end face 124 of a corresponding casing head 36, for example, to enable radially compressing a testing seal between the casing head 36 and a side portion 110 of a corresponding drilling adapter 102 above the securement component 37. Alternatively, in other embodiments, a wellhead 14 may not include a test port 145 that opens to a face seal 122.

In any case, as depicted in FIG. 10, to facilitate manipulating (e.g., deploying) the production casing hanger 32C, a lower end of a production casing running tool 100 is secured to the production casing hanger 32C, for example, while an upper end of the production casing running tool 100 may be secured to a landing joint. As more clearly visible in FIG. 2, to facilitate securing the production casing running tool 100 thereto, the production casing hanger 32C includes internal hanger threading 38 at and securement notches 40 along its upper end.

Figure 13:
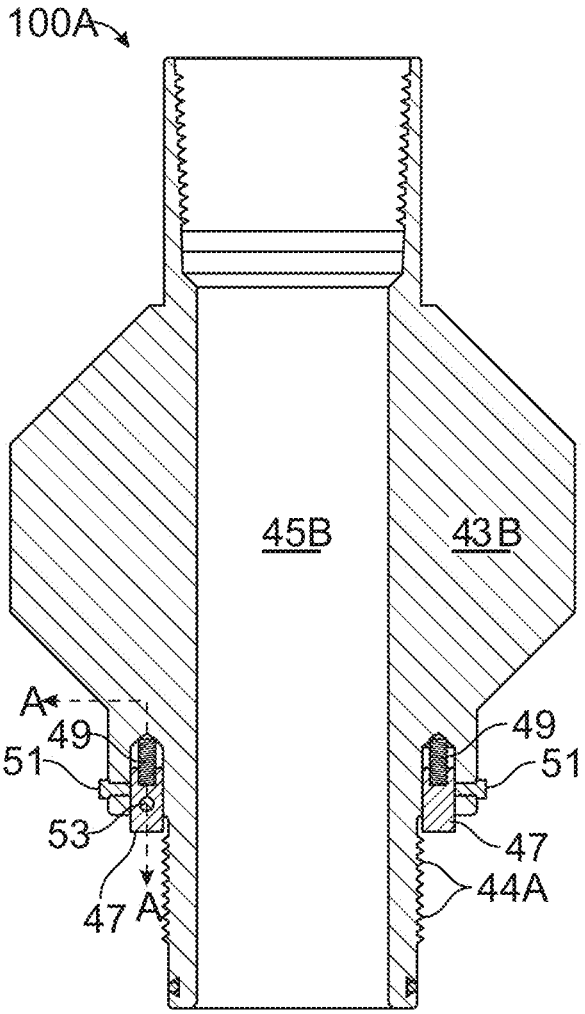
FIG. 13 is a side cross-sectional view of another example of a casing running tool, in accordance with an embodiment of the present disclosure.

To help further illustrate, a more detailed example of a production casing running tool 100A is shown in FIG. 13. As in the depicted example, a production casing running tool 100 generally includes a tool body 43B, which defines a tool bore 45B that extends therethrough.

Additionally, in the depicted example, the lower end of the production casing running tool 100A is implemented to be secured to an upper end of a production casing hanger 32C, for example, while an upper end of the production casing running tool 100 is implemented to be secured to a landing joint. In particular, to facilitate securing the production casing running tool 100A to a production casing hanger 32C, in the depicted example, the lower end of the tool body 43B includes external tool threading 44A, which is implemented (e.g., positioned, sized, and/or shaped) to interlock with internal hanger threading 38 at the upper end of the production casing hanger 32C.

However, it should be appreciated that the depicted example is merely intended to be illustrative and not limiting. In particular, to facilitate securement to a corresponding casing hanger 32, in other embodiments, a lower end of a production casing running tool 100 may include internal tool threading, for example, when an upper end of the casing hanger 32 includes external hanger threading.

In any case, to facilitate blocking the production casing running tool 100A from being inadvertently overtightened on a production casing hanger 32C-particularly when the production casing running tool 100A is used to rotate the production casing hanger 32C during cementing of a corresponding production casing string 26C, the production casing running tool 100A additionally includes securement tabs 47 as well as corresponding activation springs 49 and activation fasteners (e.g., screws and/or bolts) 51, which selectively control axial extension of the securement tabs 47 out from the tool body 43B and, thus, engagement of the securement tabs 47 with securement notches 40 on the production casing hanger 32C, for example, in addition to retention fasteners 53, which facilitate retaining the securement tabs 47 with the tool body 43B.

Figure 14:
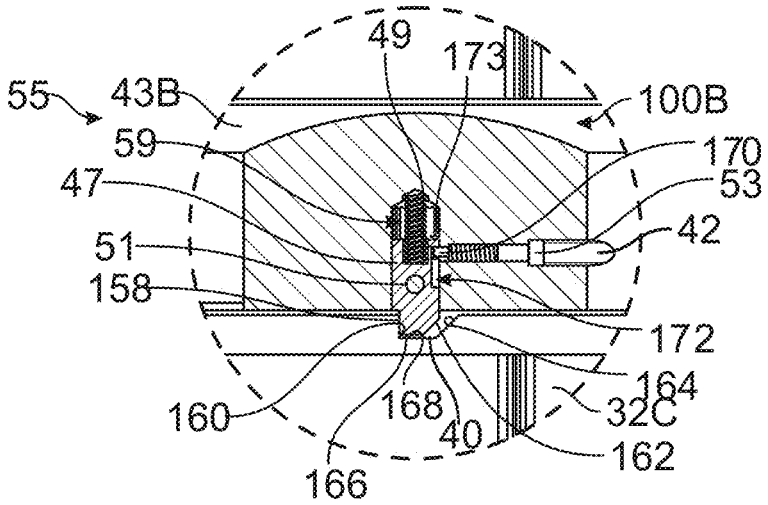
FIG. 14 is a close-up, cross-sectional view of an example of an interface between the casing running tool of FIG. 13 and a casing hanger, in accordance with an embodiment of the present disclosure.

To help more clearly illustrate, a close-up view of an example of an interface 55 between a production casing running tool 100B and a production casing hanger 32C is shown in FIG. 14. In particular, the upper end of the production casing hanger 32C of FIG. 14 generally matches the upper end of the production casing hanger 32C of FIGS.

2 and 11 while the production casing running tool 100B of FIG. 14 generally matches the production casing running tool 100A of FIG. 13.

In other words, although obfuscated from view in FIG. 14, the upper end of the production casing hanger 32C includes internal hanger threading 38 while the lower end of the production casing running tool 100B includes external tool threading 44A, which is implemented to interlock with the internal hanger threading 38 on the production casing hanger 32C. Accordingly, the production casing running tool 100B may be secured to the production casing hanger 32C at least in part by rotating the production casing running tool 100B in a first (e.g., right and/or clockwise) direction relative to the production casing hanger 32C to interlock the external tool threading 44A on the production casing running tool 100B with the internal hanger threading 38 on the production casing hanger 32C. On the other hand, the production casing running tool 100B may be disconnected (e.g., unsecured and/or removed) from the production casing hanger 32C at least in part by rotating the production casing running tool 100B in a second (e.g., left, counter-clockwise, and/or opposite) direction relative to the production casing hanger 32C to disengage the external tool threading 44A on the production casing running tool 100 from the internal hanger threading 38 on the production casing hanger 32C.

Additionally, as depicted in FIG. 14, the upper end of the production casing hanger 32C includes a securement notch 40 there along. On the other hand, the production casing running tool 100B includes a securement tab 47, which is disposed within a tab cavity 59 in its tool body 43B, and an activation spring 49, which is disposed within the tab cavity 59 between the securement tab 47 and a closed end of the tab cavity 59 and, thus, between the securement tab 47 and the tool body 43B. Accordingly, the activation spring 49 may urge the securement tab 47 from a withdrawn (e.g., deactivated) state in which a lower end of the securement tab 47 is withdrawn into the tab cavity 59 to an extended (e.g., activated) state in which the lower end of the securement tab 47 extends axially out of the tab cavity 59 and, thus, out of the tool body 43B to enable the securement tab 47 to interlock with the securement notch 40 on the production casing hanger 32C.

In other words, as in the depicted example, the shape of a securement tab 47 in a production casing running tool 100 may generally correspond to the shape of a securement notch 40 on a corresponding production casing hanger 32C. In particular, in the depicted example, the securement tab 47 includes a vertical edge 158, which is implemented to oppose a vertical sidewall 160 of the securement notch 40, a slanted edge 162, which is implemented to oppose a slanted sidewall 164 of the securement notch 40, and a horizontal lower edge 166, which connects the vertical edge 158 and the slanted edge 162 of the securement tab 47 and is implemented to oppose a horizontal base wall 168 of the securement notch 40, which connects the vertical sidewall 160 and the slanted sidewall 164 of the securement notch 40. Accordingly, when the securement tab 47 is disposed within the securement notch 40, engagement between the vertical edge 158 of the securement tab 47 and the vertical sidewall 160 of the securement notch 40 may block the production casing running tool 100 from rotating in a first (e.g., right and/or clockwise) direction relative to the production casing hanger 32C while engagement between the slanted edge 162 of the securement tab 47 and the slanted sidewall 164 of the securement notch 40 may enable the production casing running tool 100 to rotate in a second (e.g., left, counter-clockwise, and/or opposite) direction relative to the production casing hanger 32C. In other words, when interlocked with the securement notch 40, the securement tab 47 may block the production casing running tool 100B from being further tightened and, thus, overtightened on the production casing hanger 32C—particularly when the production casing running tool 100B is used to rotate the production casing hanger 32C during cementing of a corresponding production casing string 26C—while still enabling the production casing running tool 100B to be subsequently disconnected from the production casing hanger 32C and withdrawn.

Accordingly, as in the depicted example, to enable a production casing running tool 100 to be tightened on and, thus, secured to a casing hanger 32, an activation fastener 51 may be used to control extension of a corresponding securement tab 47 from the tool body 43 of the production casing running tool 100. In particular, in the depicted example, the activation fastener 51 is disposed within an activation fastener opening in the tool body 43B, which is perpendicular and connected to the tab cavity 59, such that a tip of the activation fastener 51 extends into the tab cavity 59.

As such, to enable a production casing running tool 100 to be tightened on a casing hanger 32, each of its securement tab 47 may be pushed into its tab cavity 59 and a corresponding activation fastener 51 may be tightened against the securement tab 47 to hold the securement tab 47 in its withdrawn state. Additionally, to facilitate retaining the securement tab 47 with the tool body 43B while the securement tab 47 is in its extended state, in the depicted example, a retention fastener 53 is disposed within a retention fastener opening 42 in the tool body 43B such that a tip 170 of the retention fastener 53 is disposed within a retention notch 172 along an edge of the securement tab 47 and, thus, engages a retention lip 173 at an upper end of the securement tab 47 while the securement tab 47 is in its extended state.

However, it should be appreciated that the depicted example is merely intended to be illustrative and not limiting. In particular, in other embodiments, a production casing running tool 100 may not include a retention fastener 53, for example, when a tip of a corresponding activation fastener 51 is disposed within a retention notch 172 on a corresponding securement tab 47. Additionally or alternatively, in other embodiments, a securement tab 47 in a production casing running tool 100 may not include a retention notch 172, for example, when a corresponding activation fastener 51 is retightened against the securement tab 47 after the securement tab 47 transitions from its withdrawn state to its extended state. Furthermore, in other embodiments, the vertical edge 158 of a securement tab 47 in a production casing running tool 100 may not be perfectly vertical and instead may be slightly slanted, for example, one degree, two degrees, three degrees, or less than five degrees to more tightly abut the vertical sidewall 160 of a corresponding securement notch 40 on a casing hanger 32 when the production casing running tool 100 is to be used to rotate the casing hanger 32 (e.g., during cementing). Moreover, instead of multiple distinct securement tabs 47, in other embodiments, a production casing running tool 100 may include its securement tabs 47 on a single securement tab ring, for example, which is transitioned to its extended state via a single spring.

In any case, returning to FIG. 2, to facilitate fluidly isolating (e.g., sealing) an inner annulus 30C surrounding a production casing string 26C, a wellhead 14 may include an inner packoff 74B, which lands within its casing head 36, for example, in addition to within an intermediate packoff 74A above a corresponding production casing hanger 32C. Similar to an intermediate packoff 74A, an inner packoff 74B generally includes an inner packoff body 73B, which defines an inner packoff bore 75B that extends therethrough, one or more external inner packoff seals 76B, which are each implemented to be radially compressed between the inner packoff body 73B and the intermediate packoff 74A, as well as one or more internal inner packoff seals 78B, which each implemented to be radially compressed between the inner packoff body 73B and the production casing hanger 32C.

Additionally, in the depicted example, to facilitate selective securement within the wellhead 14A, similar to the intermediate packoff 74A, the inner packoff 7B also includes an inner lockring assembly 80B. In particular, in the depicted example, the inner lockring assembly 80B includes an inwardly-biased inner lockring 82B, which is implemented (e.g., positioned, sized, and/or shaped) to interlock with an internal inner lockring groove 84B in the intermediate packoff 74A, and an inner activation (e.g., energizer) ring 85B, which facilitates selectively transitioning the inwardly-biased inner lockring 82B between a contracted (e.g., unsecured, deactivated, and/or unlocked) state and an expanded (e.g., secured, activated, and/or locked) state, which is shown in FIG. 2. More specifically, in the depicted example, while in its expanded state, the inwardly-biased inner lockring 82B of the inner packoff 74B is disposed within the internal inner lockring groove 84B in the intermediate packoff 74A such that the inwardly-biased inner lockring 82B axially overlaps with the intermediate packoff 74A, thereby securing the inner packoff 74B to the intermediate packoff 74A and, thus, within the wellhead 14A.

However, it should again be appreciated that the depicted example is merely intended to be illustrative. In particular, as will be described in more detail below, instead of including a casing hanger 32 and a separate packoff 74, in some embodiments, a wellhead 14 may include an integrated packoff and casing hanger. Additionally, as will be described in more detail below, instead of an inwardly-biased lockring 82, in other embodiments, a lockring assembly 80 of a wellhead component, such as a packoff 74 or an integrated packoff and casing hanger, may include an outwardly-biased lockring, for example, when the wellhead component is to be rotated within a corresponding wellhead 14 (e.g., during cementing).

In any case, as in the depicted example, an inwardly-biased lockring 82 may be in its expanded state while a corresponding activation ring 85 is disposed there behind and, thus, radially between the inwardly-biased lockring 82 and the body of a corresponding wellhead component, such an intermediate packoff 74A or an inner packoff 74B. In particular, inserting the activation ring 85 behind the inwardly-biased lockring 82 may expand the inwardly-biased lockring 82 radially outward, thereby transitioning the inwardly-biased lockring 82 from its contracted state to its expanded state. On the other hand, withdrawing the activation ring 85 from the inwardly-biased lockring 82 enables the inwardly-biased lockring 82 to contract radially inward and, thus, to transition from its expanded state to its contracted state. In fact, in some embodiments, a running tool used to manipulate (e.g., move, deploy, and/or remove) a wellhead component, such as a packoff 74, may also facilitate selectively transitioning its lockring between its contracted state and its expanded state and, thus, selectively securing the wellhead component within a wellhead 14.

Figure 15:
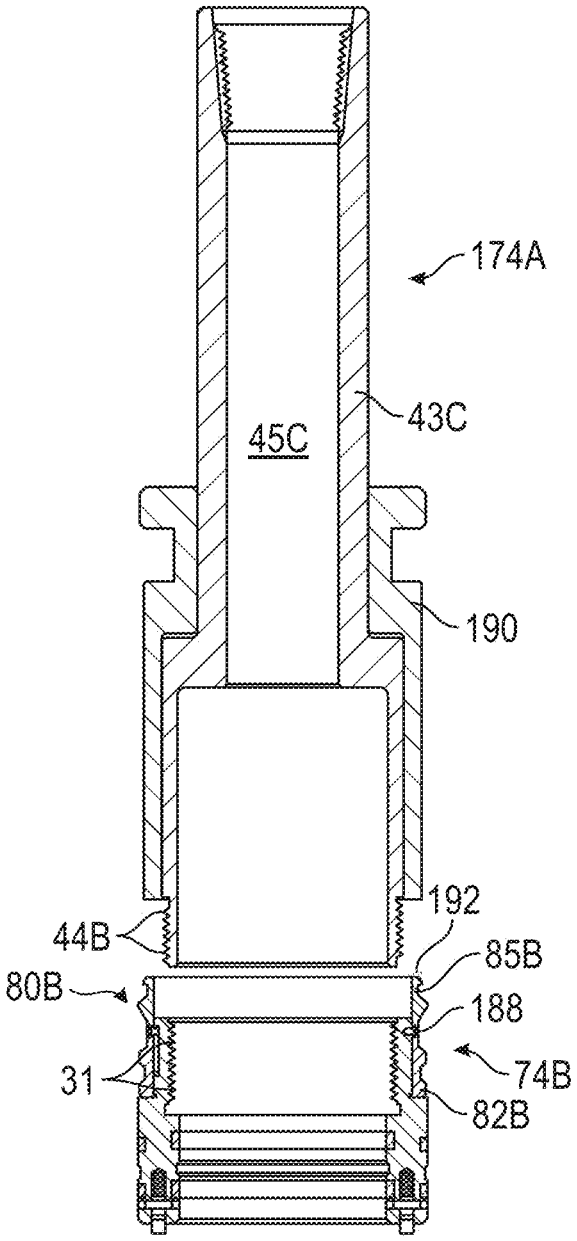
FIG. 15 is a side cross-sectional view of an example of a packoff that may be included in a wellhead and a corresponding packoff running tool, in accordance with an embodiment of the present disclosure.

To help illustrate, an example of an inner packoff 74B and a corresponding running tool—namely a packoff running tool 174A—is shown in FIG. 15. In particular, the inner packoff 74B of FIG. 15 generally matches the inner packoff 74B of FIG. 2 and, thus, has an inner lockring assembly 80B, which includes an inwardly-biased inner lockring 82B and an inner activation ring 85B.

However, while FIG. 2 shows the inwardly-biased inner lockring 82B in its expanded state due to the inner activation ring 85B being inserted there behind, FIG. 15 shows the inner activation ring 85B withdrawn from behind the inwardly-biased inner lockring 82B and, thus, the inwardly-biased inner lockring 82B in its contracted state. In fact, as in the depicted example, to facilitate blocking an inwardly-biased lockring 82 from inadvertently (e.g., prematurely and/or improperly) transitioning from its contracted state to its expanded state, in some embodiments, a packoff 74 may include one or more shear pins 188, which temporarily secure a corresponding activation ring 85 withdrawn from the inwardly-biased lockring 82, for example, before the packoff 74 is landed at its target position in a wellhead 14 and, thus, before the packoff 74 is to be secured within the wellhead 14.

However, it should be appreciated that the depicted example is merely intended to be illustrative and not limiting. In particular, in other embodiments, a packoff 74 may not include a shear pin 188, for example, when the inward bias of its inwardly-biased lockring 82 is sufficient to block a corresponding activation ring 85 from inadvertently being inserted there behind and, thus, the inwardly-biased lockring 82 from inadvertently transitioning from its contracted state to its expanded state.

In any case, similar to the surface casing running tool 46 of FIG. 3 and the production casing running tool 100A of FIG. 13, the packoff running tool 174A of FIG. 15 includes a tool body 43C, which defines a tool bore 45C that extends therethrough. Additionally, the lower end of the packoff running tool 174A is implemented to be secured to an upper end of the inner packoff 74B, for example, while an upper end of the packoff running tool 174A is implemented to be secured to a landing joint. To facilitate securing the packoff running tool 174A to the inner packoff 74B, in the depicted example, the lower end of the tool body 43C includes external tool threading 44B, which is implemented (e.g., positioned, sized, and/or shaped) to interlock with internal packoff threading 31 at the upper end of the inner packoff 74B. Accordingly, the packoff running tool 174A may be secured to the inner packoff 74B at least in part by rotating the packoff running tool 174A in a first (e.g., right and/or clockwise) direction relative to the inner packoff 74B to interlock the external tool threading 44B on the packoff running tool 174A with the internal packoff threading 31 on the inner packoff 74B. On the other hand, the packoff running tool 174A may be disconnected (e.g., removed) from the inner packoff 74B at least in part by rotating the packoff running tool 174A in a second (e.g., left, counterclockwise, and/or opposite) direction relative to the inner packoff 74B to disengage the external tool threading 44B on the packoff running tool 174A from the internal packoff threading 31 on the inner packoff 74B.

Furthermore, as depicted, to facilitate selectively inserting an activation ring 85 behind a corresponding inwardly-biased lockring 82 and, thus, transitioning the inwardly-biased lockring 82 from its contracted state to its expanded state, the packoff running tool 174A includes an activation (e.g., deployment) attachment (e.g., sleeve) 190 secured circumferentially around its tool body 43C such that a lower end of the activation attachment 190 is recessed relative to (e.g., higher than) the lower end of the tool body 43C to leave the external tool threading 44B exposed. Accordingly, the packoff running tool 174A may be secured to the inner packoff 74B at least in part by rotating the packoff running tool 174A a first amount relative to the inner packoff 74B and, subsequently, the inner packoff 74B may be secured in place at least in part by rotating the packoff running tool 174A a second amount in the same direction relative to the inner packoff 74B such that the activation attachment 190 of the packoff running tool 174A pushes the inner activation ring 85B of the inner packoff 74B downwardly (e.g., after breaking corresponding shear pins 188) behind the inwardly-biased inner lockring 82B, thereby transitioning the inwardly-biased inner lockring 82B from its contracted state to its expanded state, for example, after the inner packoff 74B has landed at its target position within a wellhead 14.

As in the depicted example, to facilitate withdrawing its activation ring 85 from its inwardly-biased lockring 82 and, thus, transitioning the inwardly-biased lockring 82 from its expanded state to its contracted state (e.g., to enable removal from a wellhead 14), in some embodiments, an upper end of the activation ring 85 may include an external retrieval lip (e.g., protrusion) 192, which extends radially outward. Additionally, in some embodiments, a packoff 74 may be deployed in a wellhead 14 and retrieved (e.g., removed) from the wellhead 14 using the same running tool.

Figure 16:
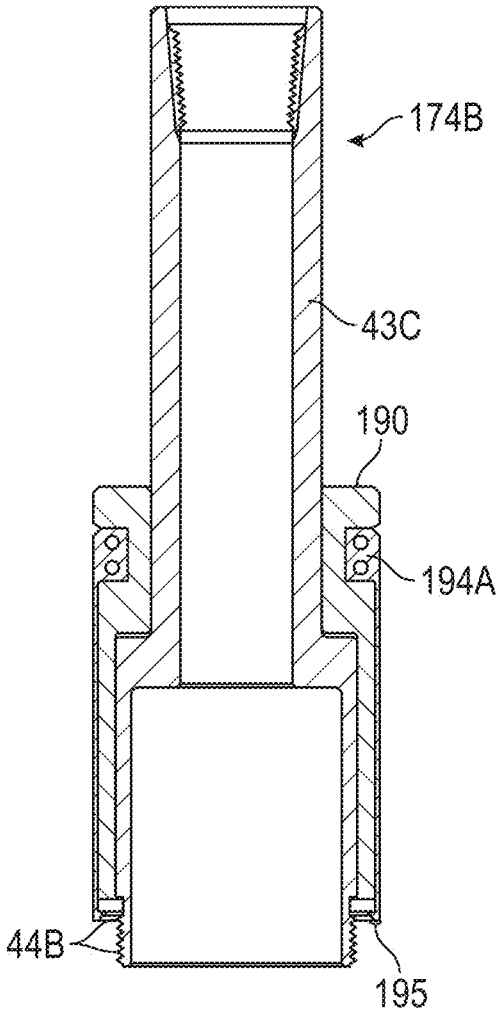
FIG. 16 is a side cross-sectional view of an example of the packoff running tool of FIG. 15 with a deactivation (e.g., retrieval) attachment, in accordance with an embodiment of the present disclosure.

To help illustrate, another example of a packoff running tool 174B is shown in FIG. 16. In particular, the packoff running tool 174B of FIG. 16 generally matches the packoff running tool 174A of FIG. 5, but with a deactivation (e.g., retrieval) attachment (e.g., sleeve) 194A secured to its tool body 43C. In particular, in the depicted example, the deactivation attachment 194A is secured circumferentially around the tool body 43C and the activation attachment 190 such that a lower end of the deactivation attachment 194A extends beyond (e.g., below) the activation attachment 190 while being recessed relative to (e.g., higher than) the lower end of the tool body 43C, for example, such that the deactivation attachment 194A partially overlaps with the external tool threading 44B on the tool body 43C.

Additionally, in the depicted example, the lower end of the deactivation attachment 194A includes an internal retrieval lip (e.g., protrusion) 195, which extends radially inward and is implemented (e.g., positioned, sized, and/or shaped) to interlock with an external retrieval lip 192 on an activation ring 85 of a packoff 74. Accordingly, the packoff 74 may be removed from a wellhead 14 at least in part by rotating the packoff running tool 174B a greater amount in a first (e.g., right and/or clockwise) direction relative to the packoff 74 to secure the packoff running tool 174B to the packoff 74 such that the internal retrieval lip 195 on the deactivation attachment 194A interlocks (e.g., engages) with an external retrieval lip 192 on an activation ring 85 of the packoff 74 before rotating the packoff running tool 174B a lesser amount in a second (e.g., left, counter-clockwise, and/or opposite) direction relative to the inner packoff 74B such that packoff running tool 174B withdraws the activation ring 85 from a corresponding inwardly-biased lockring 82 of the packoff 74, thereby enabling the inwardly-biased lockring 82 of the packoff 74 to transition from its expanded state to its contracted state while the packoff running tool 174B remains secured to the packoff 74 and, thus, the packoff running tool 174B to be used to subsequently withdraw the packoff 74 from the wellhead 14.

However, it should be appreciated that the depicted example is merely intended to be illustrative and not limiting. In particular, in other embodiments, a deactivation attachment 194A may be secured directly around the tool body 43 of a running tool without an activation attachment 190 disposed therebetween. Additionally, although primarily described with reference to an inner packoff 74B, in other embodiments, the techniques of the present disclosure may be applied to an intermediate packoff 74A in an analogous manner.

In any case, as depicted in FIG. 2, while in its expanded state, the inwardly-biased intermediate lockring 82A of the intermediate packoff 74A matingly interlocks with the internal intermediate lockring groove 84A in the casing head 36 and, thus, the inner profile (e.g., shape) of the internal intermediate lockring groove 84A generally conforms to (e.g., matches) an outer surface profile of the inwardly-biased intermediate lockring 82A. However, in the depicted example, while nevertheless interlocking to block relative axial movement, the inner profile of the internal inner lockring groove 84B in the intermediate packoff 74A does not conform to the outer surface profile of the inwardly-biased inner lockring 82B.

Figure 17:
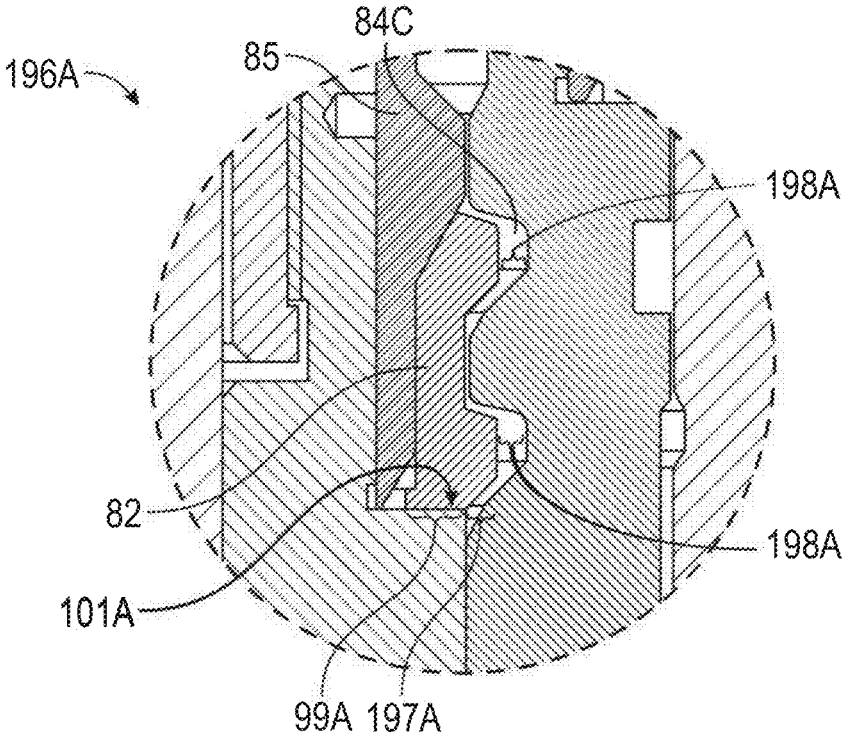
FIG. 17 is a close-up, cross-sectional view of an example of an interface between an inwardly-biased lockring and a bi-directional lockring groove in a wellhead, in accordance with an embodiment of the present disclosure.

To help more clearly illustrate, a close-up view of an example of an interface 196A between an inwardly-biased lockring 82 and a corresponding lockring groove 84—namely a bi-directional lockring groove 84C—is shown in FIG. 17. As depicted, while in its expanded state, the inwardly-biased lockring 82 extends into the bi-directional lockring groove 84C to block relative axial movement.

However, in the depicted example, the inner profile of the bi-directional lockring groove 84C intentionally differs from the outer surface profile of the inwardly-biased lockring 82 such that one or more gaps (e.g., open space) 198A remain within the bi-directional lockring groove 84C even while the inwardly-biased lockring 82 is in its expanded state. In particular, as in the depicted example, in some embodiments, a bi-directional lockring groove 84C may extend deeper than and/or change at different (e.g., steeper and/or shallower) angles as compared to a compatible inwardly-biased lockring 82.

Nevertheless, to facilitate transitioning an inwardly-biased lockring 82 that is inadvertently stuck in its expanded state (e.g., due to debris) to its contracted state even after a corresponding activation ring 85 is withdrawn, in the depicted example, an upper end of the bi-directional lockring groove 84C is slanted downwardly, for example, while an upper end of a protruding portion 197A of the inwardly-biased lockring 82 is also slanted downwardly and a lower end of a recessed portion 99A of the inwardly-biased lockring 82 and a corresponding (e.g., opposing) surface 101A of a corresponding wellhead component, such as a packoff 74, are not slanted (e.g., flat and/or horizontal). Accordingly, in the depicted example, when upward force is applied while the activation ring 85 is withdrawn, the downwardly-slanted upper end of the bi-directional lockring groove 84C may engage the upper end of the protruding portion 197A of the inwardly-biased lockring 82 to push the inwardly-biased lockring 82 radially inward and, thus, facilitate transitioning the inwardly-biased lockring 82 from its expanded state to its contracted state.

Nevertheless, it should be appreciated that the depicted example is merely intended to be illustrative and not limiting. In particular, in other embodiments, an inwardly-biased lockring 82 and/or a corresponding bi-directional lockring groove 84C may have a different shape. For example, in other embodiments, an upper end of a bi-directional lockring groove 84C may not be slanted downwardly (e.g., instead being flat and/or horizontal). In any case, in some embodiments, a bi-directional lockring groove 84C may be used in a wellhead 14 to enable securement using either an inwardly-biased lockring 82 or an outwardly-biased lockring, which may be included in an integrated packoff and casing hanger.

Figure 18:
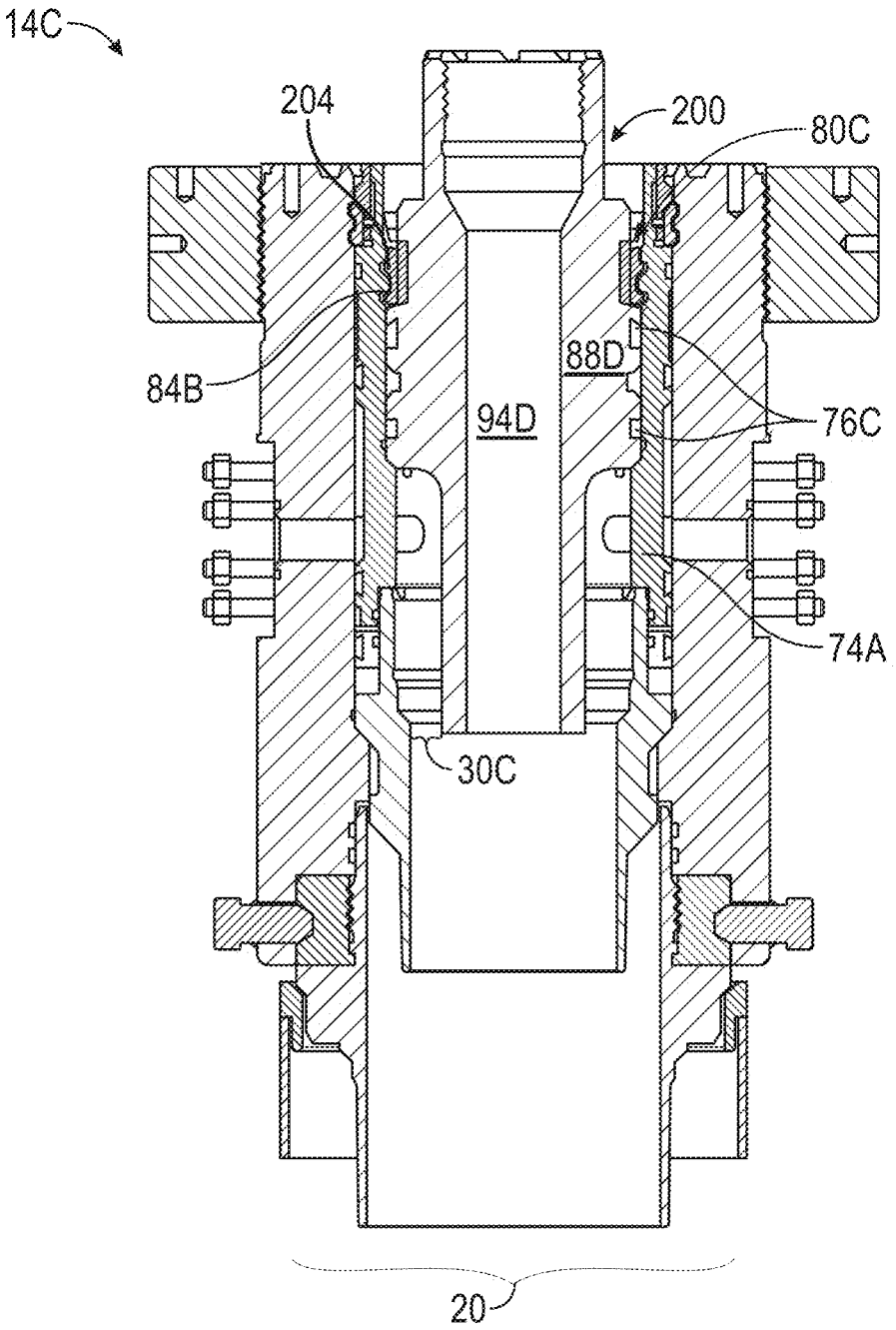
FIG. 18 is a side cross-sectional view of a further example of a wellhead that may be deployed in the well system of FIG. 1, in accordance with an embodiment of the present disclosure.

To help illustrate, another example of a wellhead 14C is shown in FIG. 18. The wellhead 14C of FIG. 18 generally matches the wellhead 14A of FIG. 2 except, instead of a production casing hanger 32C and a separate inner packoff 74B, the wellhead 14C of FIG. 18 includes an integrated packoff and casing hanger 200. In particular, similar to the production casing hanger 32C of FIG. 2, to facilitate suspending a production casing string 26C within a wellbore 20, the integrated packoff and casing hanger 200 of FIG. 18 includes a hanger body 88D, which defines a hanger bore 94D that extends therethrough, and has a lower end that is implemented to be secured to an upper end of the production casing string 26C, for example, while an upper end of the integrated packoff and casing hanger 200 is implemented to be selectively secured to a corresponding production casing running tool 100.

Additionally, similar to the inner packoff 74B of FIG. 2, to facilitate fluidly isolating (e.g., sealing) an inner annulus 30C surrounding a production casing string 26C, the integrated packoff and casing hanger 200 includes external packoff seals 76C, which are each implemented to be radially compressed between its hanger body 88D and the intermediate packoff 74A. Furthermore, similar to the inner packoff 74B of FIG. 2, to facilitate selective securement to the intermediate packoff 74A, the integrated packoff and casing hanger 200 of FIG. 19 includes a lockring assembly 80C.

However, as depicted in FIG. 18, instead of an inwardly-biased lockring 82 and an activation ring 85, the lockring assembly 80C of the integrated packoff and casing hanger 200 includes an outwardly-biased lockring 204, for example, to enable a production casing running tool 100 to rotate the integrated packoff and casing hanger 200 during cementing of a corresponding casing string 26 before subsequently securing (e.g., locking) the integrated packoff and casing hanger 200 in place and disconnecting from the integrated packoff and casing hanger 200. Nevertheless, similar to FIG. 2, to facilitate selectively securement to the intermediate packoff 74A, the outwardly-biased lockring 204 of the integrated packoff and casing hanger 200 is implemented to selectively transition between a contracted (e.g., unsecured, deactivated, and/or unlocked) state and an expanded (e.g., secured, activated, and/or locked) state, which is shown in FIG. 18.

However, it should be appreciated that the depicted example is merely intended to be illustrative and not limiting. In particular, in other embodiments, a lockring assembly 80 of an integrated packoff and casing hanger 200 may nevertheless include an inwardly-biased lockring 82 and an activation ring 85. Additionally, in other embodiments, an integrated packoff and casing hanger 200 may include a single external packoff seal 76 or more than two (e.g., three, four, or more) external packoff seals 76. Furthermore, in other embodiments, a packoff 74, which is to be used with a separate casing hanger 32, may nevertheless include an outwardly-biased lockring 204. Moreover, although primarily described as being used to replace a production casing hanger 32C and a separate inner packoff 74B, in other embodiments, an integrated packoff and casing hanger 200 may be implemented to additionally or alternatively replace an intermediate casing hanger 32B and a separate intermediate packoff 74A in an analogous manner.

In any case, in some embodiments, an integrated packoff and casing hanger 200 may be manipulated (e.g., moved, deployed, and/or removed) at least in part using the same running tool as would have been used to manipulate a corresponding discrete (e.g., separate) casing hanger 32. In other words, in some embodiments, the integrated packoff and casing hanger 200 of FIG. 18 may be manipulated at least in part using the production casing running tool 100A of FIG. 13.

Figure 19:
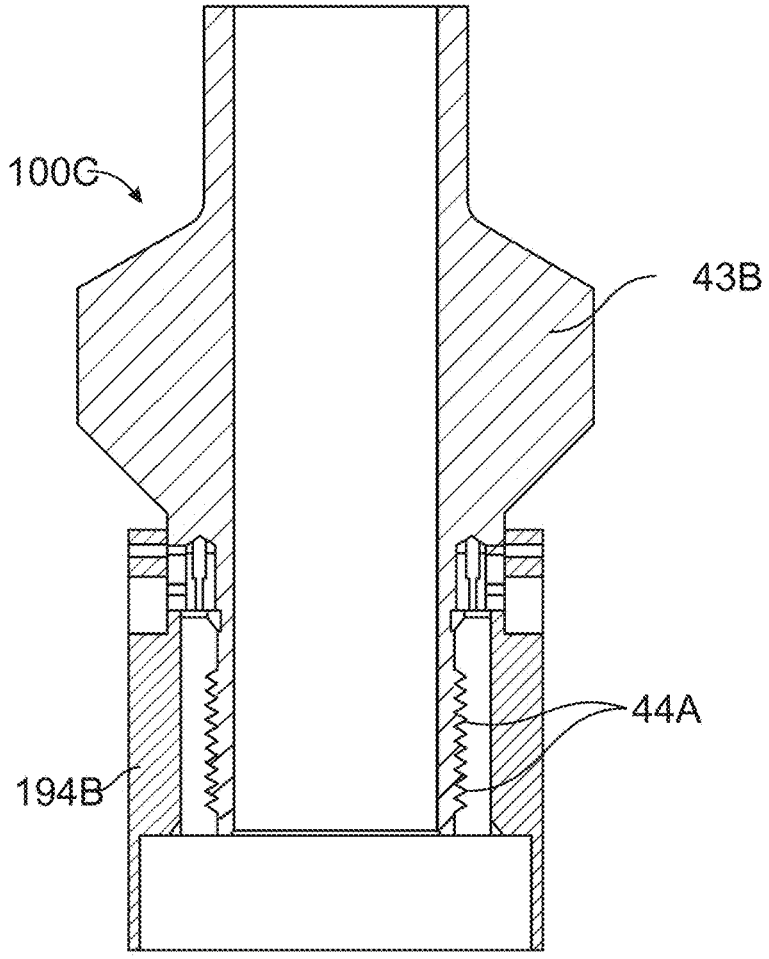
FIG. 19 is a side cross-sectional view of an example of the casing running tool of FIG. 13 with a deactivation (e.g., deployment and/or retrieval) attachment, in accordance with an embodiment of the present disclosure.

To help illustrate, another example of a production casing running tool 100C is shown in FIG. 19. In particular, the production casing running tool 100C of FIG. 19 generally matches the production casing running tool 100A of FIG. 13, but with a deactivation (e.g., deployment and/or retrieval) attachment (e.g., sleeve) 194B secured to its tool body 43B.

More specifically, in the depicted example, the deactivation attachment 194B is secured circumferentially around the tool body 43C such that a lower end of the deactivation attachment 194B extends beyond (e.g., below) a lower end of the tool body 43C and, thus, beyond the external tool threading 44A on the tool body 43C. Accordingly, tightening the production casing running tool 100C of FIG. 19 on the integrated packoff and casing hanger 200 of FIG. 18 may move the production casing running tool 100C and the integrated packoff and casing hanger 200 toward one another such that the deactivation attachment 194B is inserted in front of the outwardly-biased lockring 204 of the integrated packoff and casing hanger 200, thereby compressing the outwardly-biased lockring 204 radially inward and, thus, transitioning the outwardly-biased lockring 204 from its expanded (e.g., secured, activated, and/or locked) state to its contracted (e.g., unsecured, deactivated, and/or unlocked) state. On the other hand, loosening the production casing running tool 100C of FIG. 19 from the integrated packoff and casing hanger 200 of FIG. 18 may move the production casing running tool 100C and the integrated packoff and casing hanger 200 away from one another such that the deactivation attachment 194B is withdrawn from in front of the outwardly-biased lockring 204, thereby enabling the outwardly-biased lockring 204 to expand radially outward and, thus, to transition from its contracted state to its expanded state, for example, after the integrated packoff and casing hanger 200 is landed at its target position within a wellhead 14.

However, it should be appreciated that the depicted example is merely intended to be illustrative and not limiting. In particular, in other embodiments, a specialized running tool may be used to manipulate an integrated packoff and casing hanger 200. For example, in other embodiments, instead of including a separate component, a deactivation attachment 194 may be integrated with the tool body 43 of a casing running tool such that the tool body 43 includes an integrated deactivation component.

In any case, as depicted in FIG. 18, while in its expanded state, the outwardly-biased lockring 204 of the integrated packoff and casing hanger 200 interlocks with the internal inner lockring groove 84B in the intermediate packoff 74A such that the outwardly-biased lockring 204 axially overlaps with the intermediate packoff 74A, thereby securing the integrated packoff and casing hanger 200 to the intermediate packoff 74A and, thus, within the wellhead 14C. However, since implemented (e.g., positioned, sized, and/or shaped) to also selectively interlock with an inwardly-biased lockring 82 as shown in FIG. 2, as depicted in FIG. 18, the inner profile (e.g., shape) of the internal inner lockring groove 84B in the intermediate packoff 74A also does not conform to the outer surface profile of the outwardly-biased lockring 204.

Figure 20:
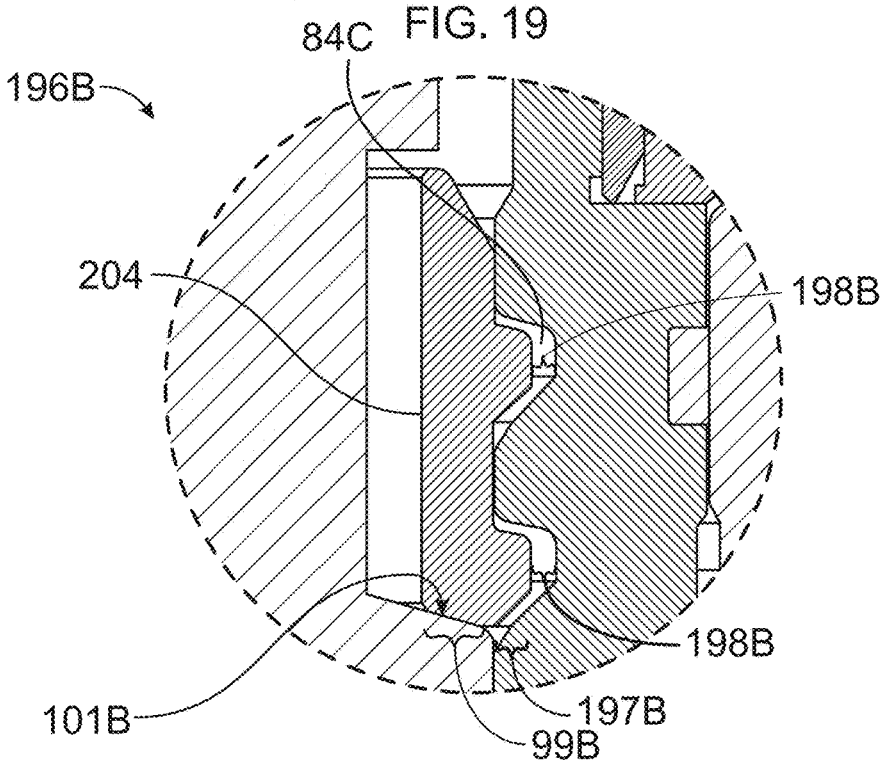
FIG. 20 is a close-up, cross-sectional view of an example of an interface between an outwardly-biased lockring and the bi-directional lockring groove of FIG. 17, in accordance with an embodiment of the present disclosure.

To help more clearly illustrate, a close-up view of an example of an interface 196B between an outwardly-biased lockring 204 and a corresponding lockring groove 84—namely a bi-directional lockring groove 84C—is shown in FIG. 20. In particular, the bi-directional lockring groove 84C of FIG. 20 generally matches the bi-directional lockring groove 84C of FIG. 17. Additionally, similar to the inwardly-biased lockring 82 of FIG. 17, while in its expanded state, the outwardly-biased lockring 204 of FIG. 20 extends into the bi-directional lockring groove 84C to block relative axial movement.

Furthermore, similar to FIG. 17, as shown in FIG. 20, the inner profile of the bi-directional lockring groove 84C also intentionally differs from the outer surface profile of the outwardly-biased lockring 204 such that one or more gaps (e.g., open space) 198B remain within the bi-directional lockring groove 84C even while the outwardly-biased lockring 204 is in its expanded state. In particular, to enable compatibility (e.g., appropriate interlocking) with an inwardly-biased lockring 82 as well as an outwardly-biased lockring 204, the inner profile of a bi-directional lockring groove 84C may be formed based on both the outer surface profile of the inwardly-biased lockring 82 and the outer surface profile of the outwardly-biased lockring 204 and, thus, may not conform perfectly to either, for example, instead being based at least in part on an average, a maximum, and/or a minimum thereof. In any case, as in the depicted example, in some embodiments, a bi-directional lockring groove 84C may extend deeper than and/or change at different (e.g., steeper and/or shallower) angles as compared to a compatible outwardly-biased lockring 204.

Additionally, as described above, to facilitate transitioning an inwardly-biased lockring 82 that is inadvertently stuck in its expanded state to its contracted state, in the depicted example, an upper end of the bi-directional lockring groove 84C is slanted downwardly. Accordingly, when upward force is applied while using an outwardly-biased lockring 204, engagement between the downwardly-slanted upper end of the bi-directional lockring groove 84C and the upper end of a protruding portion 197B of the outwardly-biased lockring 204 may exert radially inward force on the outwardly-biased lockring 204. In other words, upward force that produces a radially inward force on the outwardly-biased lockring 204 that is sufficient to overcome the outward bias of the outwardly-biased lockring 204 may result in the outwardly-biased lockring 204 inadvertently transitioning from its expanded state to its contracted state.

To facilitate blocking an outwardly-biased lockring 204 from inadvertently transitioning from its expanded state to its contracted state, in the depicted example, a corresponding (e.g., opposing) surface 101B of a corresponding wellhead component, such as an integrated packoff and casing hanger 200, that opposes a lower end of a recessed portion 99B of the outwardly-biased lockring 204 is downwardly-slanted, for example, while the lower end of the recessed portion 99B of the outwardly-biased lockring 204 and the upper end of a protruding portion 197B are also slanted downwardly. Accordingly, when upward force is applied, engagement between the downwardly-slanted surface 101B of the wellhead component and the lower end of the recessed portion 99B of the outwardly-biased lockring 204 may exert radially outward force on the outwardly-biased lockring 204 and, thus, facilitate offsetting (e.g., canceling) radially inward force exerted on the outwardly-biased lockring 204 by the downwardly-slanted upper end of the bi-directional lockring groove 84C. In particular, to facilitate completely offsetting radially inward force produced by the downwardly-slanted upper end of the bi-directional lockring groove 84C, in some embodiments, the downwardly-slanted surface 101B of the wellhead component may be slanted downwardly at substantially the same angle.

However, it should be appreciated that the depicted example is merely intended to be illustrative and not limiting. In particular, in other embodiments, an outwardly-biased lockring 204, a corresponding bi-directional lockring groove 84C, and/or a corresponding surface 101 of a corresponding wellhead component may have a different shape. For example, in other embodiments, an upper end of a protruding portion 198 of an outwardly-biased lockring 204 may not be slanted (e.g., flat and/or horizontal). Additionally, in other embodiments, a lower end of a recessed portion 99 of an outwardly-biased lockring 204 and/or a corresponding surface 101 of a corresponding wellhead component may not be slanted downwardly (e.g., flat and/or horizontal or slanted upwardly).

In any case, in this manner, the present disclosure provides techniques for improving wellhead design, which, at least in some instances, facilitates improving deployment efficiency of wellhead components, drilling efficiency of a corresponding well, and/or production efficiency of the well. While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A well system comprising a wellhead, wherein the wellhead comprises:

a casing hanger configured to suspend a casing string within a wellbore, wherein the casing hanger comprises external hanger threading configured to interlock with internal tool threading in a casing running tool to facilitate manipulating the casing hanger via the casing running tool;

a casing head;

a retainer ring assembly, wherein the retainer ring assembly comprises:

internal ring threading configured to interlock with the external hanger threading on the casing hanger after the casing running tool is disconnected from the casing hanger to facilitate securing the retainer ring assembly to the casing hanger; and an external retainer groove;

a radial retainer fastener configured to be secured through a radial fastener opening in the casing head into the external retainer groove on the retainer ring assembly to facilitate securing the casing head to the retainer ring assembly and, thus, the casing hanger;

another casing hanger configured to land within the casing head to concentrically suspend another casing string within the wellbore; and a packoff configured to land within the casing head to facilitate sealing an annulus surrounding the another casing string, wherein:

the casing head comprises an outlet port having a first shape; and the packoff comprises a flow-by port configured to be fluidly connected to the outlet port in the casing head, wherein the flow-by port in the packoff has a second shape that is different from the first shape.

2. The well system of claim 1, wherein the another casing hanger comprises:

a support ring, wherein the support ring comprises:

an external landing shoulder configured to land on an internal landing shoulder within the casing head; and other internal ring threading; and a hanger body that defines a hanger bore extending therethrough, wherein:

the hanger body is configured to be secured to the another casing string; and the hanger body comprises external body threading configured to interlock with the other internal ring threading on the support ring to facilitate securing the hanger body to the support ring such that the hanger body extends therethrough.

3. The well system of claim 2, wherein:

the support ring of the another casing hanger comprises a first material; and the hanger body of the another casing hanger comprises a second material different from the first material.

4. The well system of claim 1, wherein:

the outlet port in the casing head has a circular shape; and the flow-by port in the packoff has an oval shape.

5. The well system of claim 1, wherein the wellhead comprises an internal bi-directional lockring groove configured to:

selectively interlock with an inwardly-biased locking lockring on a wellhead component to facilitate securing the wellhead component within the wellhead; or selectively interlock with an outwardly-biased lockring on another wellhead component to facilitate securing the another wellhead component within the wellhead.

6. The well system of claim 1, wherein:

the casing head comprises external head threading at an upper end; and the wellhead comprises:

a securement component configured to facilitate securing another wellhead component or a valve tree to the casing head, wherein the securement component comprises internal threading configured to interlock with the external head threading on the casing head; and a face seal configured to seal between an end face of the casing head and an opposing end face of the another wellhead component or the valve tree, wherein the securement component is configured to be secured to the casing head such that another end face of the securement component is recessed relative to the end face of the casing head to facilitate compressing the face seal.

7. The well system of claim 1, wherein the retainer ring assembly comprises:

a threaded retainer ring, wherein the threaded retainer ring comprises the internal ring threading and the external retainer groove; and an axial anti-rotation fastener configured to be secured through the threaded retainer ring to facilitate blocking rotation and, thus, axial movement between the retainer ring assembly and the casing hanger.

8. The well system of claim 1, wherein:

the casing hanger comprises an external retainer notch; and the retainer ring assembly comprises a plurality of ring segments, wherein the plurality of ring segments comprise:

the external retainer groove;

an internal retainer protrusion configured to interlock with the external retainer notch on the casing hanger to facilitate blocking axial movement and, thus, rotation between the retainer ring assembly and the casing hanger; and a plurality of transverse securement fasteners configured to secure the plurality of ring segment to one another.

9. A well system comprising:

a retainer ring assembly, wherein the retainer ring assembly comprises:

a threaded retainer ring, wherein the threaded retainer ring comprises:

internal ring threading configured to interlock with external hanger threading on a surface casing hanger to facilitate securing the retainer ring assembly to the surface casing hanger; and an external retainer groove;

a retainer plate secured under the threaded retainer ring, wherein a lower surface of the retainer plate is contoured with radial wedges and is configured to be disposed against a hanger shoulder of the surface casing hanger; and an axial anti-rotation fastener secured downwardly through an axial fastener opening in the threaded retainer ring to abut an upper surface of the retainer plate, wherein the axial anti-rotation fastener is configured to be tightened against the retainer plate to facilitate blocking rotation between the retainer ring assembly and the surface casing hanger; and a radial retainer fastener configured to be secured through a radial fastener opening in a casing head into the external retainer groove on the retainer ring assembly to facilitate securing the casing head to the retainer ring assembly and, thus, the surface casing hanger.

10. The well system of claim 9, wherein the axial anti-rotation fastener of the retainer ring assembly is configured to be tightened to press the retainer plate against the hanger shoulder of the surface casing hanger or into a fluid circulation flute defined in the hanger shoulder.

11. The well system of claim 9, wherein the retainer ring assembly comprises an axial securement fastener secured upwardly through the retainer plate into another axial fastener opening in the threaded retainer ring to facilitate securing the retainer plate to the threaded retainer ring.

12. A well system comprising a wellhead, wherein the wellhead comprises:

a casing hanger configured to suspend a casing string within a wellbore, wherein the casing hanger comprises external hanger threading configured to interlock with internal tool threading in a casing running tool to facilitate manipulating the casing hanger via the casing running tool;

a casing head;

a retainer ring assembly, wherein the retainer ring assembly comprises:

a threaded retainer ring that comprises:

internal ring threading configured to interlock with the external hanger threading on the casing hanger after the casing running tool is disconnected from the casing hanger to facilitate securing the retainer ring assembly to the casing hanger; and an external retainer groove; and an axial anti-rotation fastener configured to be secured through the threaded retainer ring to facilitate blocking rotation and, thus, axial movement between the retainer ring assembly and the casing hanger; and a radial retainer fastener configured to be secured through a radial fastener opening in the casing head into the external retainer groove on the retainer ring assembly to facilitate securing the casing head to the retainer ring assembly and, thus, the casing hanger.

13. The well system of claim 12, wherein:

the casing hanger comprises a fluid circulation flute configured to facilitate fluid flow into or out of an annulus surrounding the casing string; and the retainer ring assembly is configured to be secured to the casing hanger such that the axial anti-rotation fastener is axially aligned with the fluid circulation flute in the casing hanger.

14. The well system of claim 12, wherein:

the retainer ring assembly comprises a retainer plate configured to be secured under the threaded retainer ring; and the axial anti-rotation fastener of the retainer ring assembly is configured to be secured downwardly through an axial fastener opening in the threaded retainer ring to press the retainer plate against a hanger shoulder of the casing hanger or into a fluid circulation flute defined in the hanger shoulder.

15. The well system of claim 14, wherein a lower surface of the retainer plate in the retainer ring assembly is contoured with radial wedges.

16. The well system of claim 12, wherein the wellhead comprises another casing hanger configured to land within the casing head to concentrically suspend another casing string within the wellbore, wherein the another casing hanger comprises:

a support ring, wherein the support ring comprises:

an external landing shoulder configured to land on an internal landing shoulder within the casing head; and other internal ring threading; and a hanger body that defines a hanger bore extending therethrough, wherein:

the hanger body is configured to be secured to the another casing string; and the hanger body comprises external body threading configured to interlock with the other internal ring threading on the support ring to facilitate securing the hanger body to the support ring such that the hanger body extends therethrough.

17. The well system of claim 12, wherein the wellhead comprises an internal bi-directional lockring groove configured to:

selectively interlock with an inwardly-biased locking on a wellhead component to facilitate securing the wellhead component within the wellhead; or selectively interlock with an outwardly-biased lockring on another wellhead component to facilitate securing the another wellhead component within the wellhead.

18. The well system of claim 12, wherein the wellhead comprises an integrated casing hanger and packoff configured to:

land within the casing head to concentrically suspend another casing string within the wellbore; and seal an annulus surrounding the another casing string, wherein the integrated casing hanger and packoff comprises an outwardly-biased lockring configured to facilitate securing the integrated casing hanger and packoff within the wellhead such that the integrated casing hanger and packoff is rotatable within the wellhead during cementing of the annulus surrounding the another casing string.

19. The well system of claim 12, wherein:

the casing head comprises external head threading at an upper end; and the wellhead comprises:

a securement component configured to facilitate securing another wellhead component or a valve tree to the casing head, wherein the securement component comprises internal threading configured to interlock with the external head threading on the casing head; and a face seal configured to seal between an end face of the casing head and an opposing end face of the another wellhead component or the valve tree, wherein the securement component is configured to be secured to the casing head such that another end face of the securement component is recessed relative to the end face of the casing head to facilitate compressing the face seal.

* * * * *